US005531632A

United States Patent [19]

Mizutani

[11] Patent Number: 5,531,632

[45] Date of Patent: Jul. 2, 1996

[54] APPARATUS FOR DETECTING THE SURFACE OF A MEMBER TO BE GROUND, METHOD OF MANUFACTURING FEELERS, AND AUTOMATIC INSPECTION/GRINDING APPARATUS

[75] Inventor: Shigemitsu Mizutani, Kanagawa, Japan

[73] Assignee: Fuji Photo Film Co., Ltd., Kanagawa, Japan

[21] Appl. No.: 355,970

[22] Filed: Dec. 14, 1994

[30] Foreign Application Priority Data

Dec. 14, 1993 [JP] Japan ..... 5-313081
Dec. 28, 1993 [JP] Japan ..... 5-337697

[51] Int. Cl.[6] ..... B24B 49/00

[52] U.S. Cl. ..... 451/6; 73/104; 73/105

[58] Field of Search ..... 451/5, 6, 8, 49, 451/408; 73/104, 105, 863; 33/501.02, 501.04, 783, 784, 803, 805, 555.1, 558.01, 558.04

[56] References Cited

U.S. PATENT DOCUMENTS 4,803,871 2/1989 Harada et al. ..... 73/104
4,864,777 9/1989 McLaughlin et al. ..... 451/6
4,984,393 1/1991 Rogers, Jr. ..... 451/5
5,272,443 12/1993 Winchip et al. ..... 73/105
5,301,545 4/1994 Meyer et al. ..... 73/105

*Primary Examiner*—Bruce M. Kisliuk
*Assistant Examiner*—Andrew Weinberg
*Attorney, Agent, or Firm*—Sughrue, Mion, Zinn, Macpeak & Seas

[57] ABSTRACT

An apparatus for detecting a surface of a member to be ground in which feelers are disposed on, or in close proximity to, the surface of the member to be ground, a sensor detects the displacement of the feeler as a projection on the member to be ground comes into contact with the feeler when the member to be ground is moved, and the projection is detected by an output signal from the sensor and an amount of movement of the member to be ground. An automatic inspection/grinding apparatus for grinding a projection is also disclosed. Projections and the like on the surface of the member to be ground, such as a color filter, can be detected and ground accurately and simply.

16 Claims, 20 Drawing Sheets

APPARATUS FOR DETECTING THE SURFACE OF A MEMBER TO BE GROUND, METHOD OF MANUFACTURING FEELERS, AND AUTOMATIC INSPECTION/GRINDING APPARATUS

BACKGROUND OF THE INVENTION

1. Field of the Invention

The present invention relates to an apparatus for detecting the surface of a member to be ground, for detecting a projection attached to or formed on the surface of the member to be ground, a method of manufacturing feelers used in the surface detecting apparatus, and an automatic inspection/grinding apparatus for determining the presence or absence and position of a projection by inspecting the surface of a member to be ground and for grinding the detected projection by a grinding member.

2. Description of the Related Art

Liquid crystal displays (hereafter referred to as LCDs) are in widespread use as display units for displaying images converted into electric signals. An LCD has a polarizing film provided on, for example, an obverse-surface side of a liquid crystal, and light and darkness is formed on the polarizing film depending on whether or not the light transmitted through the liquid crystal is transmitted through the polarizing film.

A known LCD is arranged such that a color filter, in which very small color-component dyes of such as green, blue, and red are arranged in mosaic form, is interposed between the liquid crystal and the polarizing film, and the light transmitted through the polarizing film is adapted to produce the respective color components, so as to display a color image.

In the event that projections, foreign objects, or the like are attached to or formed on the surface of the color filter, and a gap is produced between the polarizing film and the color filter due to such projections, foreign objects, or the like, it becomes impossible to shield unnecessary light by the polarizing film, making it impossible to display a clear image. For this reason, it must be ensured that very small projections or foreign objects are not present on the surface of the color filter which is used for a color LCD.

In general, the allowable range of the projecting height of projections on the surface of the color filter used for the color LCDs is considered to be approximately 4 μm or less, and projections or foreign objects which are greater than that range need to be removed from the surface of the color filter. In so doing, since the surface of the color filter is soft, it is necessary to pay utmost care not to apply an unnecessary external force to the surface, and the operation must be performed accurately and reliably.

As apparatuses for automatically grinding projections, foreign objects, or the like attached to the surface of such a color filter, apparatuses are known in which the surface of the color filter is measured by a laser length measuring machine or the like to detect a projection having a more-than-prescribed amount of projection and calculate its position, or the surface of the color filter is imaged by a CCD image sensor, the nonconforming projection is detected and its position is determined by calculating the image information thus obtained, and grinding is automatically performed by a grinding member on the basis of the result of calculation such that the projection is reduced to a predetermined size or less.

However, such an automated grinding apparatus is precision-constructed, has a complicated structure, and is therefore very expensive. For this reason, as a generally adopted method in the operation of grinding the surface of the color filter, the operator visually inspects the presence or absence of large projections or foreign objects on the surface of the color filter in a conventional manner. When large projections or foreign objects are found, the operator grinds them manually by small degrees by using a grinding member, such as a grinding tape with abrasive particles deposited thereon, so as to remove the projections or foreign objects.

SUMMARY OF THE INVENTION

In view of the above-described circumstances, it is an object of the present invention to provide an apparatus for detecting the surface of a member to be ground, which is capable of accurately and simply detecting a projection or the like on the member to be ground such as a color filter, prior to grinding the surface of the member to be ground.

Another object of the present invention is to provide a method of manufacturing feelers which is capable of accurately mass-producing feelers for detecting the surface of the member to be ground.

Still another object of the present invention is to provide an automatic inspection/grinding apparatus which, with a simple arrangement, is capable of automatically effecting the operation from the detection of the surface of the member to be ground to grinding.

In accordance with a first aspect of the present invention, there is provided an apparatus for detecting a surface of a member to be ground, for determining the presence or absence and position of a projection needed to be ground in a subsequent process, by detecting the surface of the member to be ground, the apparatus comprising: a moving table which moves on a base; an inspection base disposed above the moving table and extending in a direction horizontally perpendicular to a moving direction of the moving table; a plurality of feelers arranged in a longitudinal direction of the inspection base, each of the plurality of feelers being rotatably supported about a lower end face of a shoulder portion straddling over a through hole provided in the inspection base, a distal end of a tongue portion extending from the shoulder portion and passing through the through hole being disposed with a predetermined gap with respect to the surface of the member to be ground, and each of the plurality of feelers being normally maintained in a balanced state; a plurality of sensors provided respectively for the plurality of feelers, a contact of each of the plurality of sensors being changed over when a state of the feeler changes between a normal state in which the feeler is balanced and an inclined state in which the feeler is rotated about the lower end face of the shoulder portion when the member to be ground is moved in conjunction with the movement of the moving table, and the projection comes into contact with the feeler; and a determining device for determining the presence or absence of the projection on the basis of an output signal from the sensor and for determining the position of the projection on the basis of an amount of movement of the moving table.

In the above-described first aspect of the present invention, a support roller which is adapted to be supported on the moving base is attached to the inspection base, and a predetermined gap is provided between a lower end of each of the feelers and the surface of the member to be ground as an interval between a horizontal line passing through a lowermost position of the support roller and a horizontal line passing through a lowermost position of each of the feelers is set to a fixed dimension.

Furthermore, the inspection base is supported on the base via an urging member, and a load corresponding to the urging force of the urging member alleviates a load transmitted from the support roller to the moving table.

In the first aspect of the present invention, the plurality of feelers are arranged in two or more rows along the longitudinal direction of the inspection base, and form areas for detecting identical locations by the rows during detection of the projection in conjunction with the movement of the moving table.

In the first aspect of the present invention, when the projection has passed through the area for detecting the identical location, and the projection is detected by two of the feelers, a position of grinding in a subsequent process is determined to be at an intermediate position between the feelers.

In accordance with a second aspect of the present invention, there is provided a method of manufacturing feelers used in the apparatus for detecting a surface of a member to be ground, comprising the steps of: when lower ends of the tongue portions are removed by cutting, fixing the feelers in state in which the feelers are superposed one on top of another by setting as a unit a plurality of feelers used for at least one surface detecting apparatus; and simultaneously cutting lower ends of the feelers such that dimensions between the lower end faces of the shoulder portions and lower end faces of the tongue portions become uniform among the superposed feelers.

In accordance with a third aspect of the present invention, there is provided an automatic inspection/grinding apparatus for determining the presence or absence and position of a projection by inspecting a surface of a member to be ground and for grinding the detected projection, the apparatus comprising: a moving table which moves on a base; an inspection base disposed above the moving table and extending in a direction horizontally perpendicular to a main moving direction of the moving table; a plurality of feelers arranged in a longitudinal direction of the inspection base, each of the plurality of feelers being rotatably supported about a lower end face of a shoulder portion straddling over a through hole provided in the inspection base, a distal end of a tongue portion extending from the shoulder portion and passing through the through hole being disposed with a predetermined gap with respect to the surface of the member to be ground, and each of the plurality of feelers being normally maintained in a balanced state; a plurality of sensors provided respectively for the plurality of feelers, a contact of each of the plurality of sensors being changed over when a state of the feeler changes between a normal state in which the feeler is balanced and an inclined state in which the feeler is rotated about the lower end face of the shoulder portion when the member to be ground is moved in conjunction with the movement of the moving table, and the projection comes into contact with the feeler; a determining device for determining the presence or absence of the projection on the basis of an output signal from the sensor and for determining the position of the projection on the basis of an amount of movement of the moving table; a grinding roller for grinding the projection; a grinding unit including a supporting member for supporting the grinding roller With a predetermined gap with respect to the surface of the member to be ground, and a lifting device for moving the grinding roller in directions toward and away from the member to be ground during the grinding of the projection, the grinding unit being disposed by being offset in the main moving direction of the moving table with respect to the inspection base, and the grinding unit being supported movably in the direction horizontally perpendicular to the main moving direction of the moving table; a moving device for moving the grinding unit in the direction horizontally perpendicular to the main moving direction of the moving table; a positioning device for determining a position of the grinding unit in the direction horizontally perpendicular to the main moving direction of the moving table by controlling the moving device on the basis of positional information obtained by the determining means; and a controller for executing grinding by causing the grinding unit to be brought into contact with the member to be ground, by controlling the lifting device on the basis of the amount of movement of the moving table at a time of detection of the projection by the feeler and an amount of offset between the position detected by the feeler and a grinding position of the grinding unit.

In accordance with a fourth aspect of the present invention, there is provided an apparatus for detecting a surface of a member to be ground, for determining the presence or absence and position of a projection needed to be ground in a subsequent process, by detecting the surface of the member to be ground, the apparatus comprising: a moving table which moves on a base; an inspection base disposed above the moving table and extending in a direction horizontally perpendicular to a moving direction of the moving table; a plurality of feelers arranged in a longitudinal direction of the inspection base, each of the plurality of feelers being rotatably supported about a lower end face of a shoulder portion straddling over a through hole provided in the inspection base, a distal end of a tongue portion extending from the shoulder portion and passing through the through hole being disposed in contact with the surface of the member to be ground; a plurality of sensors provided respectively for the plurality of feelers, a contact of each of the plurality of sensors being changed over when a state of the feeler changes between a normal state in which the feeler is balanced and an inclined state in which the feeler is displaced by the feeler when the member to be ground is moved in conjunction with the movement of the moving table; and a determining device for determining the presence or absence of the projection on the basis of an output signal from the sensor and for determining the position of the projection on the basis of an amount of movement of the moving table.

In the fourth aspect of the present invention, a support roller which is adapted to be supported on the moving base is attached to the inspection base, and the feelers are maintained in a state of contact under a very small contact pressure with respect to the member to be ground as a horizontal line passing through a lowermost position of the support roller and a horizontal line passing through a lowermost position of each of the feelers is aligned with each other.

In accordance with the first aspect of the present invention, the moving table is moved in a state in which the member to be ground is placed on the moving table.

At this time, the inspection base is disposed above the moving table, and the lower end faces of the tongue portions of the feelers oppose the surface of the member to be ground with a predetermined gap therebetween.

Since each of the feelers is supported at lower end faces of its shoulder portion in a balanced state, when the projection having a height greater than the predetermined gap comes into contact with the feeler, the feeler rotates about a supporting point at the lower end faces of the shoulder portion. Due to this rotation, the contact of the sensor is changed over, thereby making it possible to detect the presence or absence of the projection. In addition, since sensors are provided for the respective feelers, it is possible to ascertain the position of the projection by specifying the sensor which has been changed over.

If the positional information on the ascertained projection is displayed on a display unit or the like in the form of coordinates, or the member to be ground is graphically displayed and the position is pointed out, it is possible to allow the operator to ascertain the position of the projection.

Furthermore, in order to maintain the gaps between the feelers and the member to be ground to a fixed dimension, the inspection base is provided with a support roller, and the inspection base is supported on the moving table by this support roller. Meanwhile, if the gap between a horizontal line passing through the lowermost portion of the support roller and a horizontal line passing through each of the rollers is set in advance to a predetermined gap, even if the moving table slightly moves vertically, it is possible to maintain the gap to a fixed dimension by following the same.

In addition, in a case where the inspection base is supported on the moving table by the support roller, if all the load is imparted from the support roller to the moving table, there is the risk of damaging the moving table and the member to be ground and hampering the movement of the moving table. Accordingly, the inspection base is supported on the base via the urging member. As a result, the load transmitted from the support roller to the moving table can be alleviated by the portion of the urging force of the urging member.

In addition, the feelers are arranged in two or more rows along the longitudinal direction of the inspection base. At this time, areas of detecting the projections are made to overlap between the rows. Consequently, it is possible to arrange the feelers without gaps, and it is possible to prevent an omission in the detection of the projection.

In addition, although the position of grinding to be executed in a subsequent process is generally set to be the position of the feeler, but in a case where the projection is detected by two feelers, the position of grinding is set to an intermediate position between the two feelers. Consequently, two grinding operations which would otherwise be required can be completed by one grinding operation.

In accordance with the second aspect of the present invention, although the feelers need to be finished with high accuracy, it is difficult to finish a large volume of feelers with an identical dimension. Accordingly, the feelers used for at least one surface detecting apparatus are fixed in state in which the feelers are superposed one on top of another, and lower ends of the feelers are cut such that dimensions between the lower end faces of the shoulder portions and lower end faces of the tongue portions become uniform among the superposed feelers. As a result, the feelers used for at least one surface detecting apparatus are finished with high accuracy, so that it is possible to prevent variations in the gap among the feelers.

In accordance with the third aspect of the present invention, the position of the grinding unit in a direction horizontally perpendicular to the main moving direction of the moving table is determined by the positioning device by controlling the moving device on the basis of positional information obtained by the determining means. Then, grinding is executed by causing the grinding unit to be brought into contact with the member to be ground, by controlling the lifting device on the basis of the amount of movement of the moving table at a time of detection of the projection by the feeler and an amount of offset between the position detected by the feeler and a grinding position of the grinding unit.

Thus, since the arrangement for detecting the projection attached to the member to be ground and the arrangement for grinding the projection on the member to be ground are juxtaposed to each other, and the member to be ground is moved by using the same moving table, it is possible to automate the process from the detection of the projection on the member to be ground to the grinding thereof, and substantially improve the operating efficiency.

In accordance with the fourth aspect of the present invention, the moving table is moved in a state in which the member to be ground is placed on the moving table.

At this time, the inspection base is disposed above the moving table, and the lower end faces of the tongue portions of the feelers are in contact with the surface of the member to be ground. Since each of the feelers is supported at lower end faces of its shoulder portion in a balanced state, the contact pressure exerted on the member to be ground is very small, so that even if the feelers slide on the surface of the member to be ground, the surface of the member to be ground is not damaged.

Here, if there is a projection on the member to be ground, the projection comes into contact with the feeler, and the feeler rotates about the supporting point at the lower end faces of the shoulder portion. Due to this rotation, the contact of the sensor is changed over, thereby making it possible to detect the presence or absence of the projection. In addition, in the determining device, since the sensors are provided for the respective feelers, it is possible to ascertain the position of the projection by specifying the sensor which has been changed over.

If the positional information on the ascertained projection is displayed on a display unit or the like in the form of coordinates, or the member to be ground is graphically displayed and the position is pointed out, it is possible to allow the operator to ascertain the position of the projection.

In the fourth aspect of the present invention, in order to maintain the gap between the inspection base which supports the feelers and the member to be ground to a fixed dimension, the inspection base is provided with a support roller, and the inspection base is supported on the moving table by this support roller. Meanwhile, if a horizontal line passing through the lowermost portion of the support roller and a horizontal line passing through each of the rollers are aligned with each other, even if the moving table slightly moves vertically, it is possible to prevent a change in the contact pressure by following the same, and prevent the feelers from being moved away from the member to be ground.

As described above, the apparatus for detecting the surface of a member to be ground offers an outstanding advantage in which the projection or the like on the member to be ground such as a color filter can be detected accurately and simply, prior to grinding the surface of the member to be ground.

In addition, the method of manufacturing feelers offers an advantage in that feelers for detecting the surface of the member to be ground can be mass-produced with high accuracy.

In addition, the automatic inspection/grinding apparatus offers, in addition to the advantages of the first aspect of the invention, an outstanding advantage in that the apparatus, with a simple arrangement, is capable of automatically effecting the operation from the detection of the surface of the member to be ground to grinding.

The above and other objects, features and advantages of the present invention will become more apparent from the following detailed description of the invention when read in conjunction with the accompanying drawings.

BRIEF DESCRIPTION OF THE DRAWINGS

FIG. 17 comprising

DESCRIPTION OF THE PREFERRED EMBODIMENTS (First Embodiment)

Figure 1:
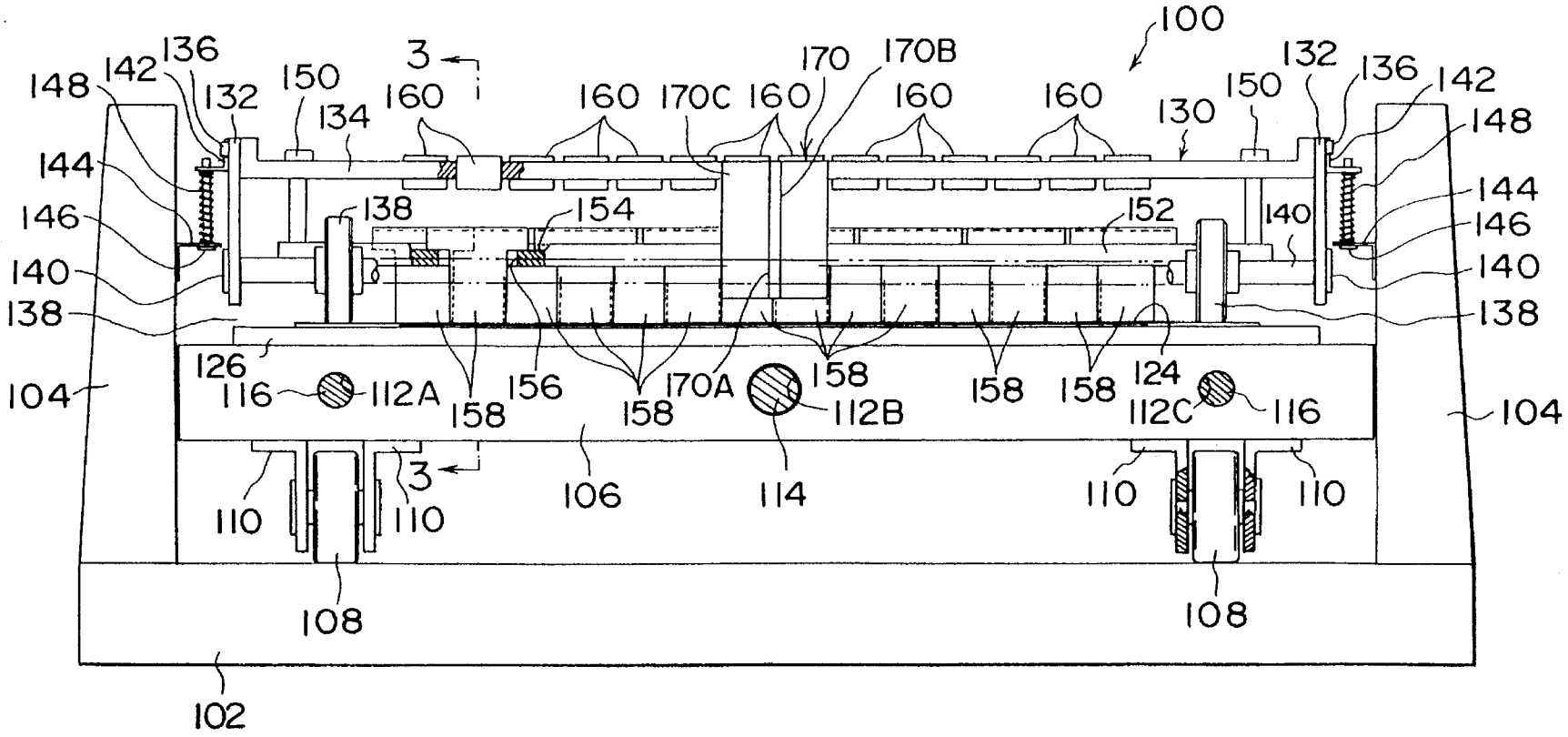
FIG. 1 is a front elevational view of a surface detecting apparatus in accordance with a first embodiment.

FIG. 1 shows an apparatus 100 for detecting the surface of a color filter in accordance with a first embodiment.

As shown in FIG. 1, a pair of vertical walls 104 are fixed to a base 102 at longitudinally opposite ends thereof, respectively, thereby forming a substantially U-shaped configuration as a whole. A moving table 106 is supported on the base 102 by means of supporting rollers 108.

Each supporting roller 108 is held by a pair of substantially L-shaped brackets 110 on both sides thereof, and horizontal surface portions of the brackets 110 are secured to the underside of the moving table 106. Three circular through holes 112A to 112C are provided in the moving table 106 in such a manner as to extend in the transverse direction thereof.

An internal thread is formed on the inner peripheral surface of the central circular hole 112B among the three circular holes 112A to 112C, and a drive shaft 114 on which an external thread is formed meshes with the internal thread. Meanwhile, guide shafts 116 are respectively inserted in the circular holes 112A and 112C on both sides of the circular hole 112B.

Figure 4:
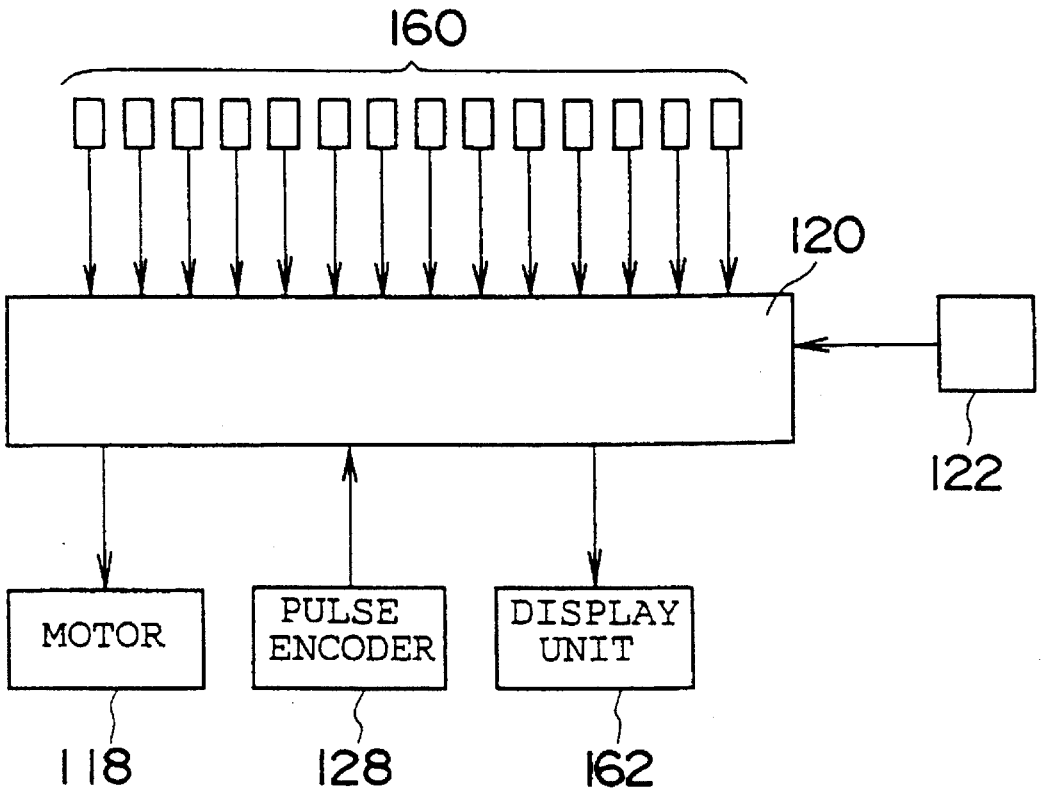
FIG. 4 is a control block diagram in accordance with the first embodiment.

The drive shaft 114 is connected to a rotating shaft of a motor 118 (see FIG. 4). This motor 118 rotates in forward and reverse directions in response to signals outputted from a controller 120 which is operated by a start switch 122 connected to the controller 120, as shown in FIG. 4. The arrangement provided is such that when the drive shaft 114 is rotated by the driving force of the motor 118, the position at which the drive shaft 114 meshes with the internal thread moves, thereby allowing the moving table 106 to move along the axial direction of each guide shaft 116. At this time, since the moving table 106 is supported on the base 102 by means of the supporting rollers 108, and is guided by the guide shafts 116, the moving table 106 moves while maintaining a state of parallelism with the base 102.

A placing table 126 for placing thereon a color filter 124, i.e., an item to be inspected, is mounted on the upper surface of the moving table 106. As the color filter 124 is placed on the placing table 126 at a predetermined position thereof, and the motor 118 is driven, the color filter 124 can be moved.

Also, as shown in FIG. 4, the motor 118 is provided with a pulse encoder 128, so as to detect the amount of movement of the moving table 106, i.e., the amount of movement of the color filter 124, in the form of pulse values.

An inspection device unit 130 is disposed on the moving table 106 in correspondence with the moving path of the color filter 124. The inspection device unit 130 has a pair of side plates 132 respectively provided uprightly along the vertical walls 104, and a ceiling base 134 extends between these side plates 132 and is fixed to them by screws 136.

Figure 2:
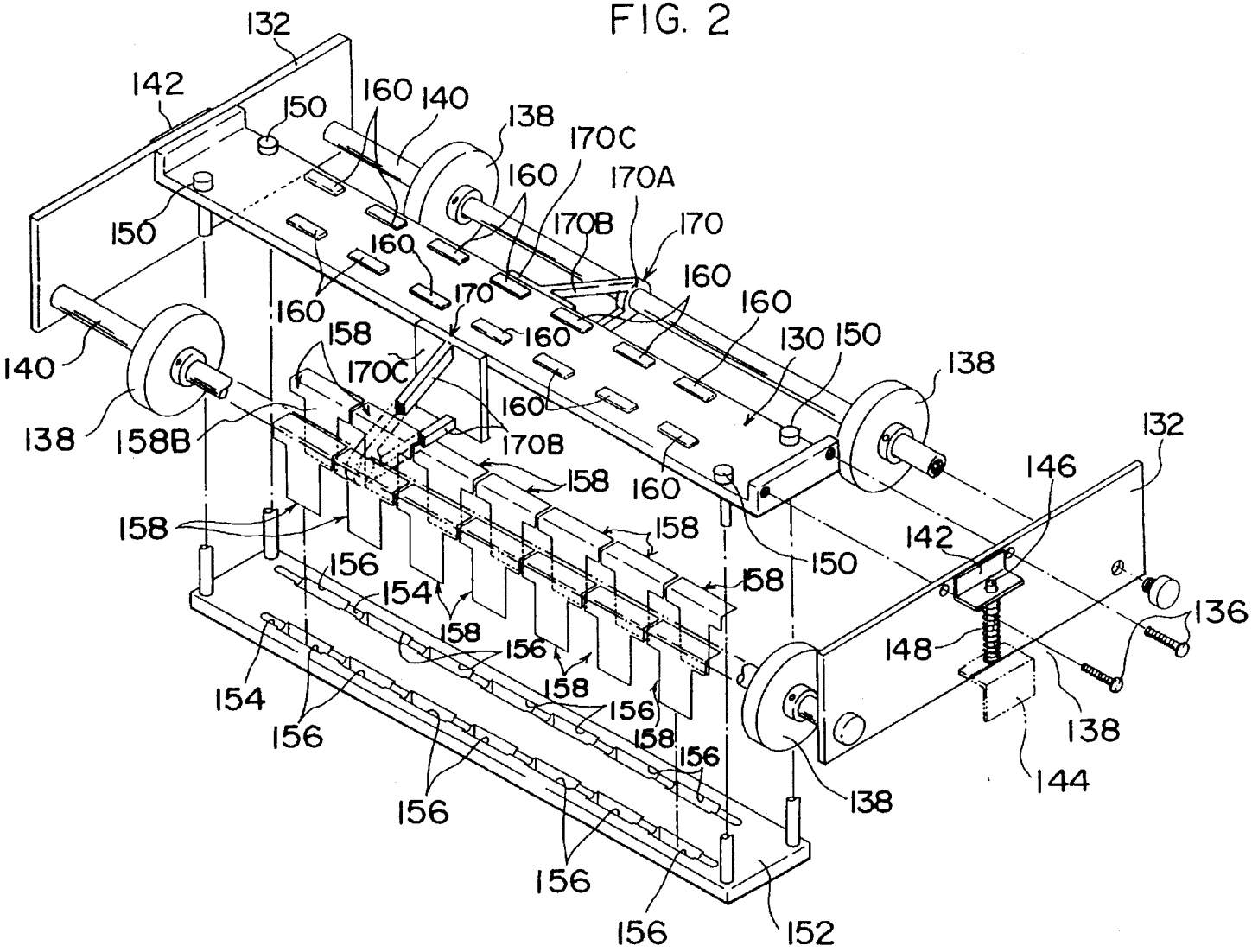
FIG. 2 is an exploded perspective view of an inspection device unit in accordance with the first embodiment.

As shown in FIG. 2, a pair of shafts 140 extend between inner surfaces of the side plates 132, and two support rollers 138 are rotatably supported by each of the shafts 140. The support rollers 138 are movable in the axial directions of the respective shafts 140, are moved in conformity to the size of the color filter 124 on the placing table 126, and are placed on outer ends of the color filter 124. An axially central portion of each shaft 140 is inserted in a hollow cylindrical supporting portion 170A. The supporting portion 170A constitutes a portion of a bracket 170. The bracket 170 is comprised of an arm section 170B for forming the supporting portion 170A at a distal end, and a baseplate 170C for supporting a proximal portion of the arm section 170B, the baseplate 170C being fixed to a side surface of the ceiling base 134. As a result, the deflection of the shaft 140 is prevented, so that the axis of the shaft 140 is always kept linear at whatever positions the support rollers 138 are located.

A substantially L-shaped bracket 142 is attached to an outer surface of each side plate 132. Meanwhile, a substantially L-shaped bracket 144 is attached to each vertical wall 104 as well, and horizontally extending portions of the brackets 142 and 144 are arranged in face-to-face relation to each other.

Holes are concentrically provided in the horizontally extending portions, respectively, of the brackets 142 and 144 arranged in face-to-face with each other. A headed pin 146 is inserted into the circular hole of the bracket 144 on the vertical wall 104 side from a lower side thereof, and a distal end of the headed pin 146 is inserted into the circular hole of the bracket 142 on the side plate 132 side. Consequently, the relative positions of the inspection device unit 130 and the vertical walls 104 are determined, and even if the moving table 106 is moved along the guide shafts 116, the inspection device unit 130 is not moved, and only the support rollers 138 are rotated.

A compression coil spring 148 is fitted around an intermediate portion of the headed pin 146, i.e., between the brackets 142 and 144. This compression coil spring 148 receives a load of the inspection device unit 130, ad serves to alleviate the load applied from the support rollers 138 to the placing table 126.

As shown in FIG. 2, shafts 150 are respectively suspended from four corners of the ceiling base 134 of the inspection device unit 130, and an inspection base 152 is attached to lower ends thereof. A parallel state of the inspection base 152 with respect to the ceiling base 134 is maintained.

Figure 3A:
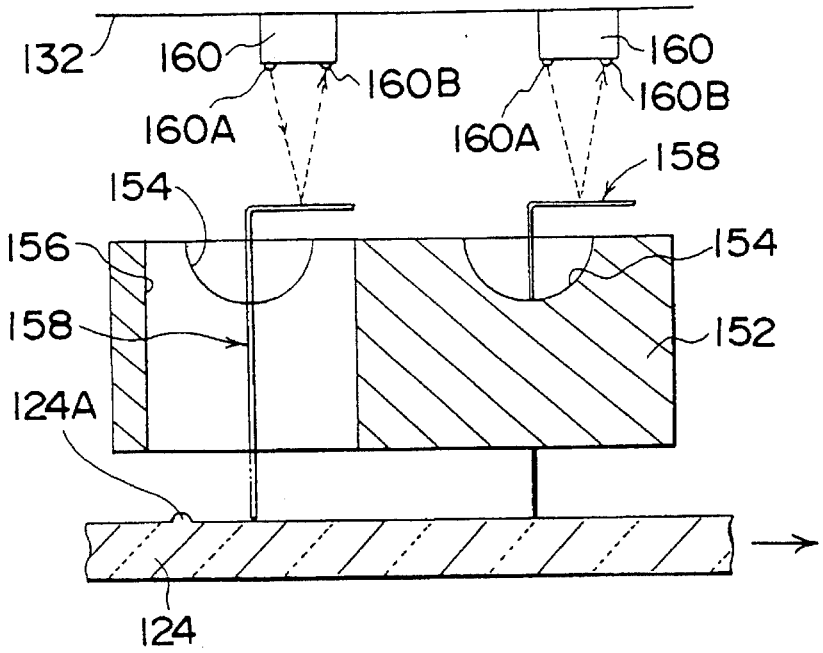
FIG. 3A is a cross-sectional view taken along line 3—3 in FIG. 1, and illustrates a normal state of feelers in accordance with the first embodiment.
Figure 3B:
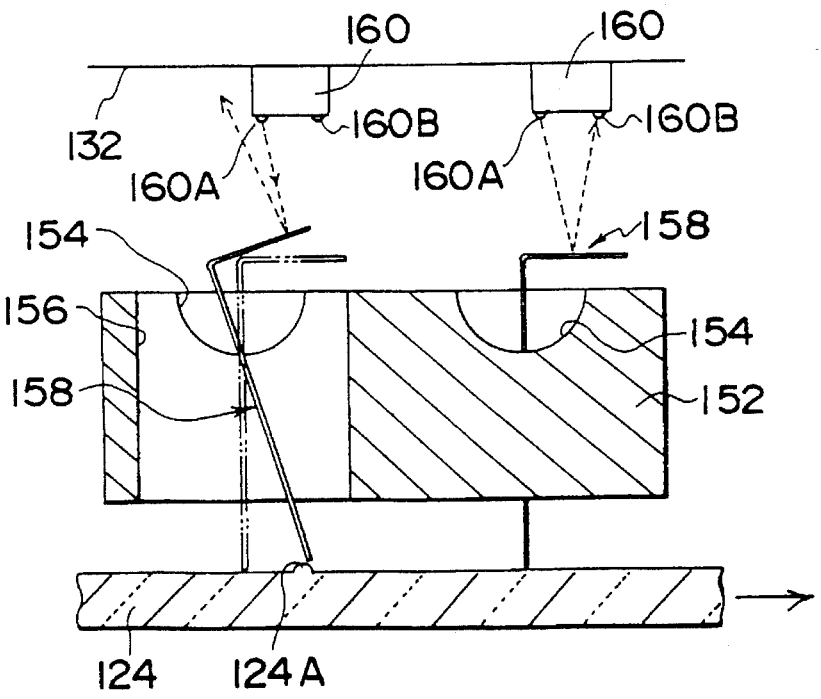
FIG. 3B is a cross-sectional view taken along line 3—3 in FIG. 1, and illustrates a state of interference by a projection in accordance with the first embodiment.

As also shown in FIGS. 3A and 3B, two arcuate grooves 154 are formed in the inspection base 152 along the longitudinal direction. Seven rectangular through holes 156 are provided at equal intervals in each of the arcuate grooves 154. The positions of the rectangular holes 156 in one arcuate groove 154 are offset from the positions of the rectangular holes 156 in the other arcuate groove 154 in the longitudinal direction of the inspection base 152. As for the amount of this offset, a description will be given later.

A feeler 158 for detecting a projection 124A (see FIGS. 3A and 3B) attached to or formed on the surface of the color filter 124 is inserted through each of the rectangular holes 156.

Figure 5:
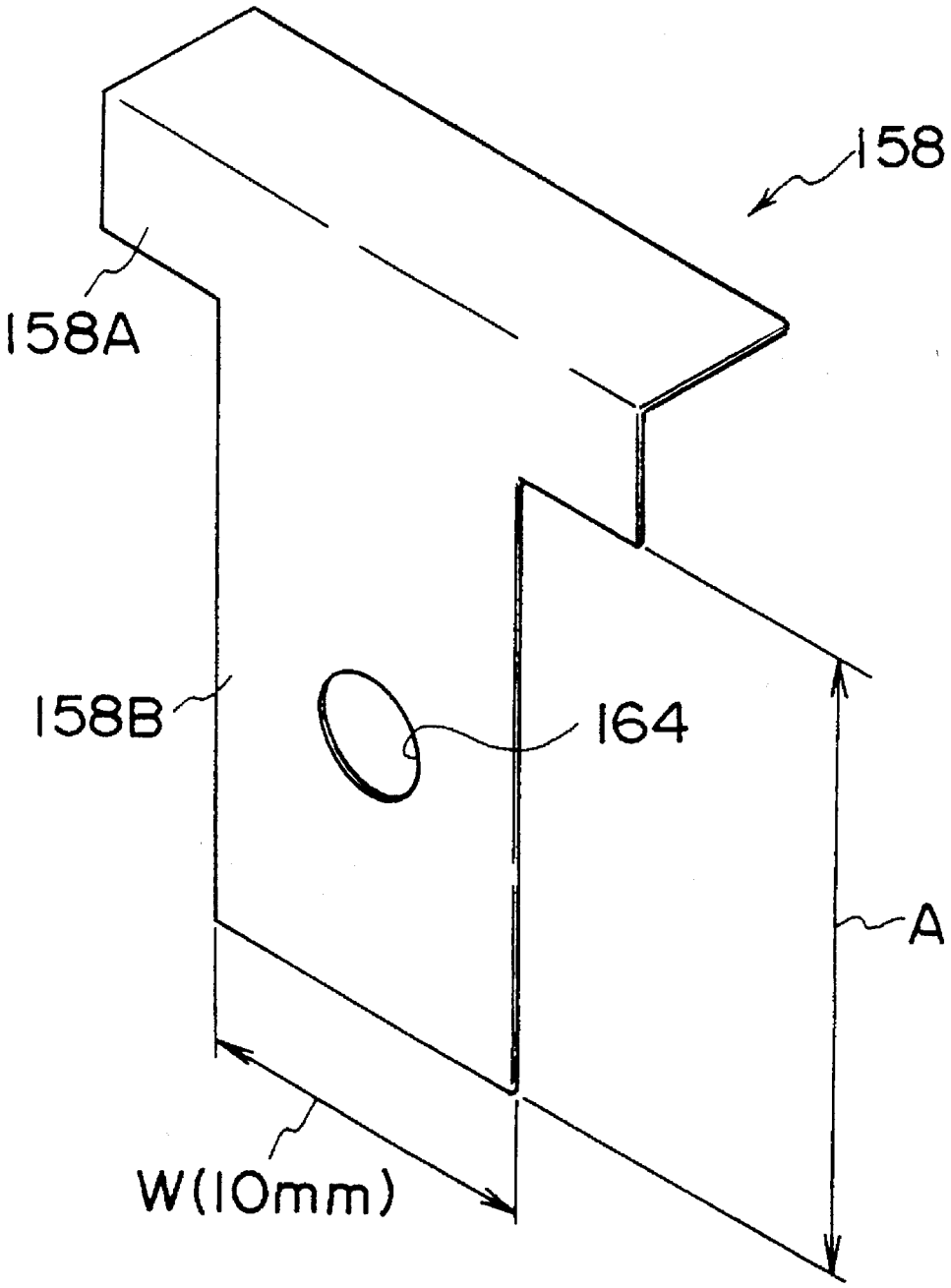
FIG. 5 is a perspective view of a feeler.

As shown in FIG. 5, the feeler 158 is formed by blanking a thin metal sheet substantially into a T-shape, and its upper portion is bent substantially orthogonally. The feeler 158 has a thickness of approximately 0.1 to 0.2 mm, and is made of stainless steel or titanium.

This feeler 158 is arranged such that its tongue portion 158B is inserted through the rectangular hole 156 with its shoulder portion 158A supported in the arcuate groove 154, and its lower end portion projects downward from the lower surface of the inspection base 152. In a normal state in which the shoulder portion 158A is supported in the arcuate groove 154, the feeler 158 is balanced so that an upper bent portion of the shoulder portion 158A is set in a horizontal state.

A dimension A from a lower end of the shoulder portion 158A to a tip of the tongue portion 158B is determined with a high degree of accuracy, such that a gap of 4 μm is formed with respect to the flat surface of the color filter 124 placed on the placing table 126.

A widthwise dimension W of the tongue portion 158B is set to be 10 mm, and the tongue portions 158B are arranged at 19-mm pitches in one arcuate groove 154. The amount of offset of the rectangular holes 156 between the two arcuate grooves 154 is set to be 9.5 mm. As a result, the feelers 158 are arranged in a state in which, as viewed in FIG. 1, the feelers 158 between the two arcuate grooves 154 overlap by 0.5 mm each.

Reflection-type photosensors 160 are attached to the ceiling base 134 in correspondence with the upper bent surfaces of the shoulder portions 158A of the respective feelers 158. These photosensors 160 are connected to the controller 120.

The upper bent surface of the shoulder portion 158A of the feeler 158 is provided with mirror finish, so that, in the above-described normal state, the upper bent surface of the shoulder portion 158A is capable of reflecting light outputted from a light-projecting portion 160A (see FIGS. 3A and 3B) of the photosensor 160 so as to guide the same to a light-receiving portion 160B (see FIGS. 3A and 3B) thereof. Namely, in the normal state when the surface of the color filter 124 is smooth, each photosensor 160 is set in a light-receiving state (e.g., in an energized state) (see FIG. 3A). Here, when the projection 124A (having a height of, for example, 4 μm or more) reaches the position where the feeler 158 is located in conjunction with the movement of the moving table 106, the feeler 158 is rotated by the projection 124A with the supporting surface of the arcuate groove 154 as the center (see FIG. 3B). As a result, the light from the light-projecting portion 160A does not reach the light-receiving portion 160B, so that the photosensor 160 is set in the light-nonreceiving state (e.g., in a deenergized state). The controller 120 is capable of specifying the position of the projection 124A from a number representing the photosensor 160 which was set in the deenergized state and from a pulse value from the pulse encoder 128 attached to the motor 118.

In this embodiment, the position of the projection 124A thus specified is displayed on a display unit 162 connected to the, controller 120 in the form of coordinate values (x, y) with a predetermined corner of the color filter 124 set as an origin.

Incidentally, since the feelers 158 are provided in two rows and overlap by 0.5 mm each, there are cases where when the projection 124A reaches the overlapping portion, two feelers 158 are rotated one after another, and two photosensors 160 are thereby deenergized. In this case, an intermediate position between the two feelers 158 is displayed in the form of coordinates.

Figure 6:
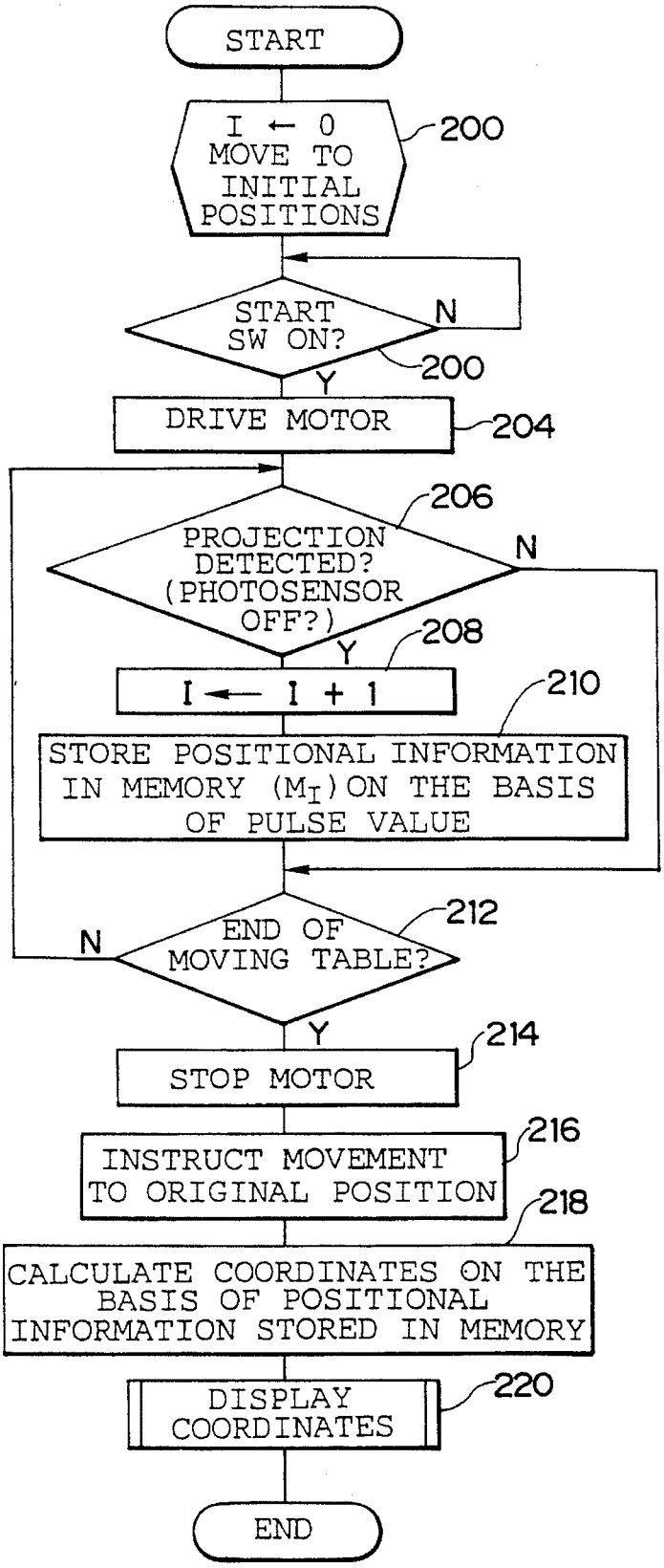
FIG. 6 is a control flowchart in accordance with the first embodiment.

Referring now to the flowchart shown in FIG. 6, a description will be given of the operation of this embodiment.

First, in Step 200, a variable I is reset to 0, and each section is moved to an initial position. Namely, the moving table 106 is returned to the initial position, the color filter 124 is placed thereon at a predetermined position, and the count of the pulse encoder 128 is reset.

In an ensuing Step 202, a determination is made as to whether the start switch 122 has been operated, and if YES is the answer in the determination, the operation proceeds to Step 204 to start the driving of the motor 118.

As the motor 118 is driven, the drive shaft 114 is rotated, so that the moving table 106 is moved along the guide shafts 116. At this time, since the moving table 106 is supported by the base 102 by means of the support rollers 108, the moving table 106 moves while maintaining a state of parallelism with the base 102.

When the moving table 106 moves, the color filter 124 on the placing table 126 is moved consecutively to the position where the feelers 158 are located. At this time, in the case of the normal smooth surface, the feelers 158 do not move since there is a gap (approx. 4 μm) between their lower ends and the surface of the color filter 124 (see FIG. 3A), For this reason, the light from the light-projecting portion 160A of the photosensor 160 is reflected by the mirror-finished bent horizontal surface of the shoulder portion 158A, and reaches the light-receiving portion 160B, so that the photosensor 160 is set in the energized state.

Here, when the projection 124A comes into contact with the feeler 158 (see FIG. 3B), the feeler 158 is rotated about a supporting portion at a lower end face of the shoulder portion 158A in the arcuate groove 154. As a result, the light from the light-projecting portion 160A of the photosensor 160 does not reach the light-receiving portion 160B, so that the photosensor 160 is set in the deenergized state (Step 206). Hence, the projection 124A is ascertained, and I is incremented in step 208. Then, in Step 210, information on the position of the projection 124A is stored in a memory ($M_I$) on the basis of the number of the deenergized photosensor 160 and a pulse number from the pulse encoder 128 at that time, and the operation proceeds to Step 212.

It should be noted that even if the projection 124A is not detected in Step 206, the operation proceeds to Step 212. If the moving table 106 has not reached a terminating end in Step 212, the aforementioned Steps 206 and 212 (when the projection 124A is not detected) or Steps 206, 208, 210, and 212 (when the projection 124A is detected) are repeated.

If it is determined in Step 212 that the moving table 106 has reached the terminating end, the operation proceeds from Step 212 to Step 214 to stop the driving of the motor 118. Then, in Step 216, an instruction is given to move the various sections to original positions, and the operation proceeds to Step 218.

In Step 218, the coordinates are calculated on the basis of the positional information stored in the memory, and the operation proceeds to Step 220 to display the calculated coordinate values on the display unit 162, thereby ending the processing.

Incidentally, when the projection 124A is located at an overlapping portion of the feelers 158, the two feelers 158 are rotated, and the two photosensors 160 are deenergized, in which case it suffices if the coordinates of an intermediate position between the two are displayed.

Thus, even if the operator does not conduct visual inspection, it is possible to readily detect the projection 124A (a projection of, for example, 4 μm or more to be ground) on the color filter 124 with a simple structure, so that the grinding operation in a subsequent process can be performed easily.

Although, in this embodiment, the coordinates of the position of the projection 124 are calculated and displayed, the coordinates may be printed out by a printer, or graphics (the configuration of the color filter) may be displayed and a mark may be provided at the detected position of the projection.

Figure 7:
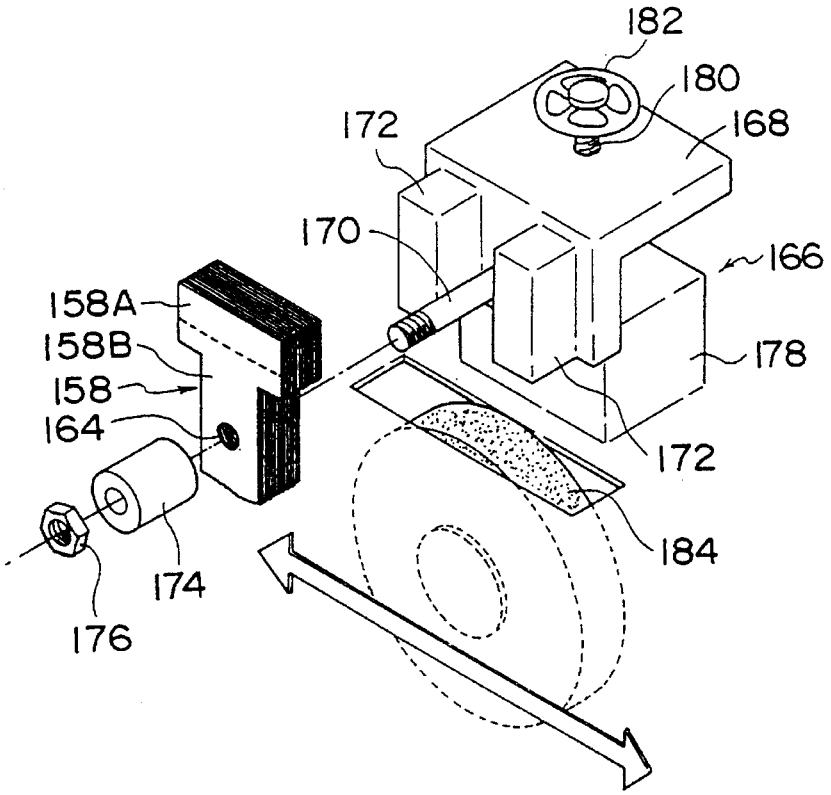
FIG. 7 is a perspective view of a jig used in manufacturing the feelers.

Although the arrangement and operation of the apparatus 100 for detecting the surface of a color filter have been described above, the projection 124A cannot be detected with high accuracy unless the feelers 158 used in this surface detecting apparatus 100 are fabricated with high accuracy. Accordingly, a description will be given of an example of a method of manufacturing the feelers 158 with reference to FIGS. 7 and 8.

First, after a substantially T-shaped blank is formed by using a thin metal, a circular hole 164 is provided in a central portion of the tongue portion 158B before the upper portion of the shoulder portion 158A is bent.

Next, the feelers 158 in a multiple of the number (14 in this embodiment) of the feelers 158 used in at least one surface detecting apparatus 100 are stacked one on top of another, and are passed through a shaft 170 projecting from a movable base 168 of a jig 166.

At this juncture, since a pair of rectangular blocks 172 are formed on the movable base 168 with the shaft 170 placed therebetween, an end face of the stack of the feelers 158, ranging from the shoulder portion 158A to the tongue portion 158B, is brought into contact with the side surfaces of the blocks 172, and positioning is thereby effected.

In this state, a spacer 174 is passed through the shaft 170, and a nut 176 is threadedly engaged on an external thread provided on a distal-end portion of the shaft 170, and is tightened, thereby completing the fixing of the feelers 158 to the jig 166.

In this state, the finished state of the lower end faces of the tongue portions 158B of the feelers 158 is poor due to burrs and the like formed during blanking.

The movable base 168 is threadedly engaged on an externally threaded shaft 180 projecting from a fixed base 178, and is vertically movable as a handle 182 is operated.

Figure 8:
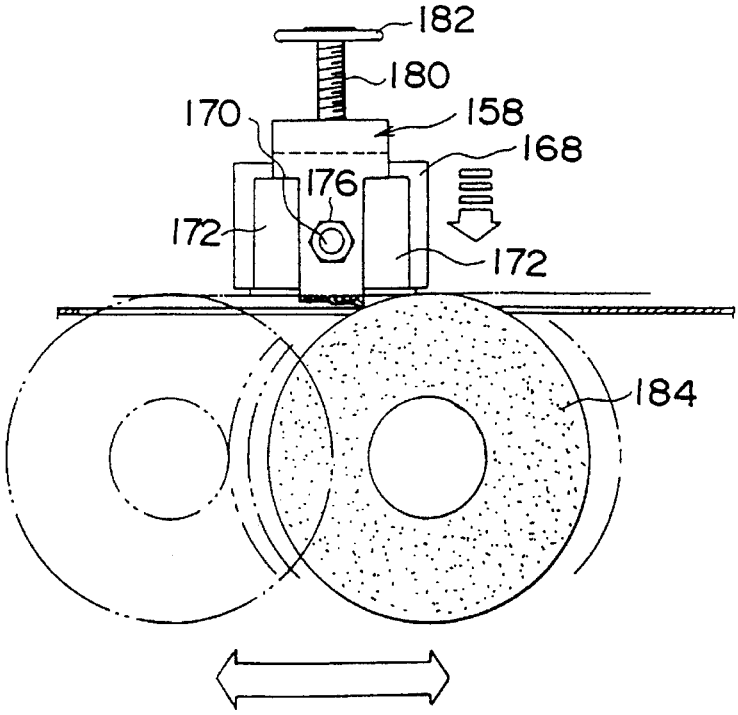
FIG. 8 is a front elevational view of the jig used in manufacturing the feelers.

For this reason, to make the projecting lengths (dimension A) of the tongue portions 158B uniform, the handle 182 is operated to lower the movable base 168. Here, the portion (a hatched portion in FIG. 8) of the stack which projects downward from the alternate long and short dash line in FIG. 8 is a portion which interferes with a grinding roller 184, and is ground as the grinding roller 184 is rotated at a high speed while being moved in a horizontal direction (in the direction indicated by the double-headed arrow in FIG. 7). As the movable base 168 is gradually lowered to set the projecting lengths of the tongue portions 158B to a targeted length, the plurality of feelers 158 are ground simultaneously, so that the dimensions A of the feelers 158 can be finished to the same dimension.

Subsequently, the feelers 158 are removed from the jig 166, and the upper portions of the shoulder portions 158A are bent by 90° one piece at a time, thereby fabricating the feelers 158 with high accuracy.

Figure 18:
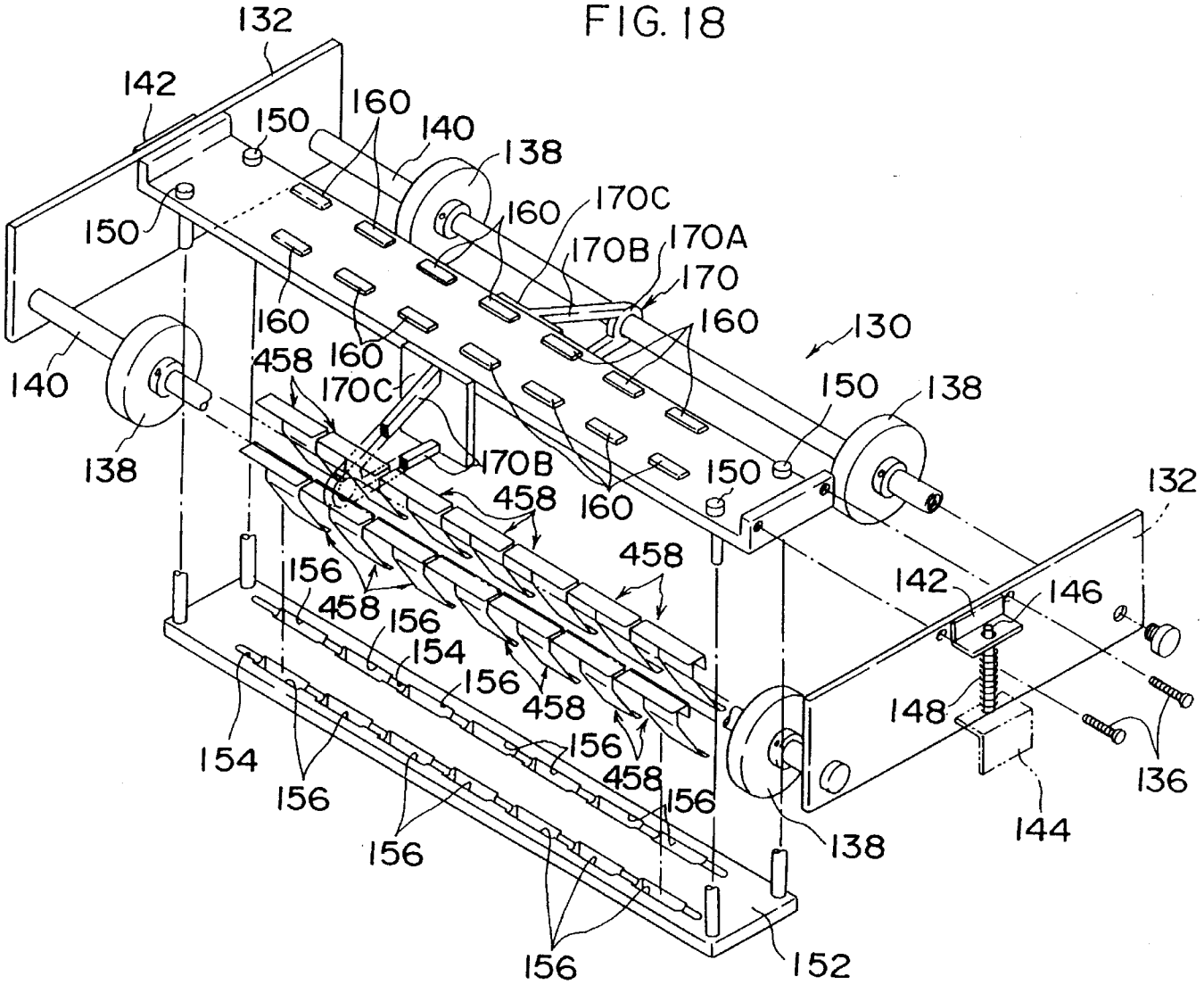
FIG. 18 is exploded perspective view of an inspection device unit using modified feelers.
Figure 19A:
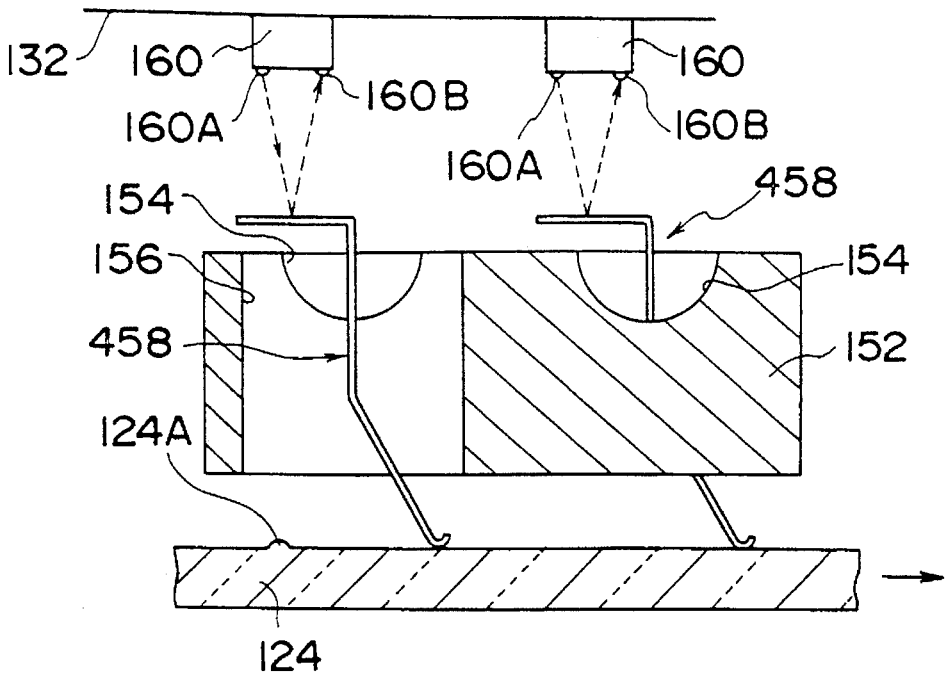
FIG. 19A is a cross-sectional view taken along line 3—3 in FIG. 1 and illustrates a normal state of the feelers in accordance with the modification.
Figure 19B:
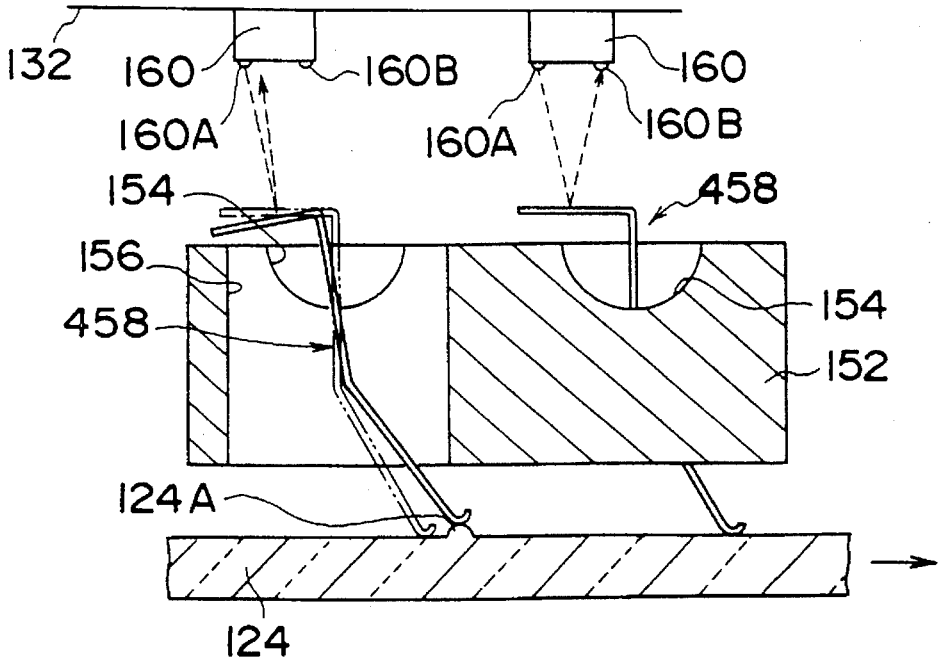
FIG. 19B is a cross-sectional view taken along line 3—3 in FIG. 1, and illustrates a state of interference by the projection in accordance with the modification.
Figure 20:
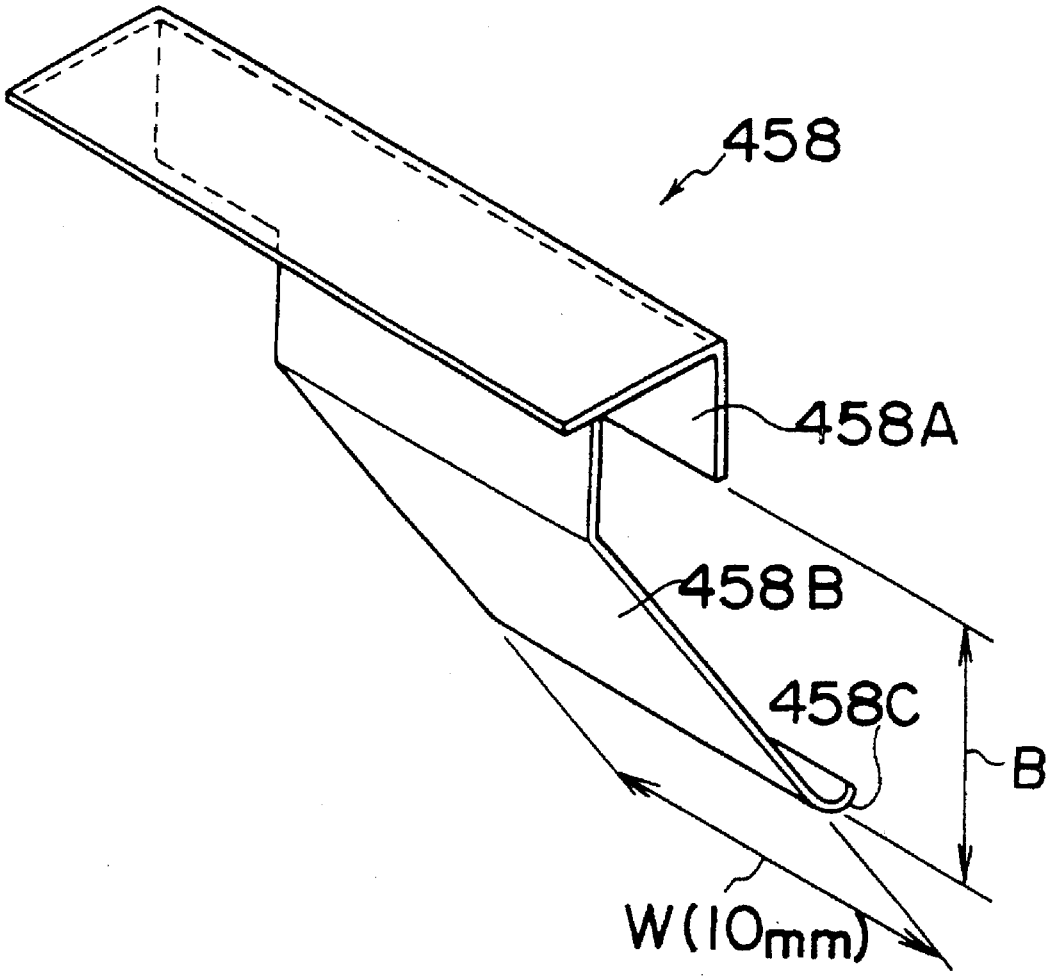
FIG. 20 a perspective view of the modified feeler.

Referring now to FIGS. 18 to 20, a description will be given of a modification of the feeler. Component parts and portions which are identical to those of the first embodiment will be denoted by the same reference numerals, and a description thereof will be omitted. FIG. 18 shows an inspection device unit in accordance with the modification.

As shown in FIGS. 19A and 19B, a feeler 458 is arranged such that its tongue portion 458B is inserted through the rectangular hole 156 with its shoulder portion 458A supported in the arcuate groove 154, and its lower end portion projects from the lower surface of the inspection base 152. The tongue portion 458B is bent at its intermediate portion by a predetermined angle, so that the tongue portion 458B extends in such a manner as to approach the color filter 124 from a diagonal direction. A tip of this extended portion is curled into an arcuate shape, and this arcuate surface 458C (shown in FIG. 20) is in contact with the color filter 124.

In the normal state in which the shoulder portion 458A is supported in the arcuate groove 154, the feeler 458 is balanced so that the upper bent portion of the shoulder portion 458A is set in a horizontal state. In this balanced state, the arcuate surface 458C of the tongue portion 458B is brought into contact with the color filter 124 with a very small contact pressure. Namely, a dimension B from a lower end of the shoulder portion 458A to the tip (a lower end position of the arcuate surface) of the tongue portion 458B is determined with high accuracy to ensure that no gap is formed with respect to the smooth surface of the color filter 124 placed on the placing table 126.

The widthwise dimension W of the tongue portion 458B is set to 10 mm, and the tongue portions 458B are arranged at 19-mm pitches in one arcuate groove 154. The amount of offset of the rectangular holes 156 between the two arcuate grooves 154 is set to be 9.5 mm. As a result, in the state as viewed in FIG. 1, the feelers 458 are arranged in a state in which they overlap by 0.5 mm each.

(Second Embodiment)

Figure 9:
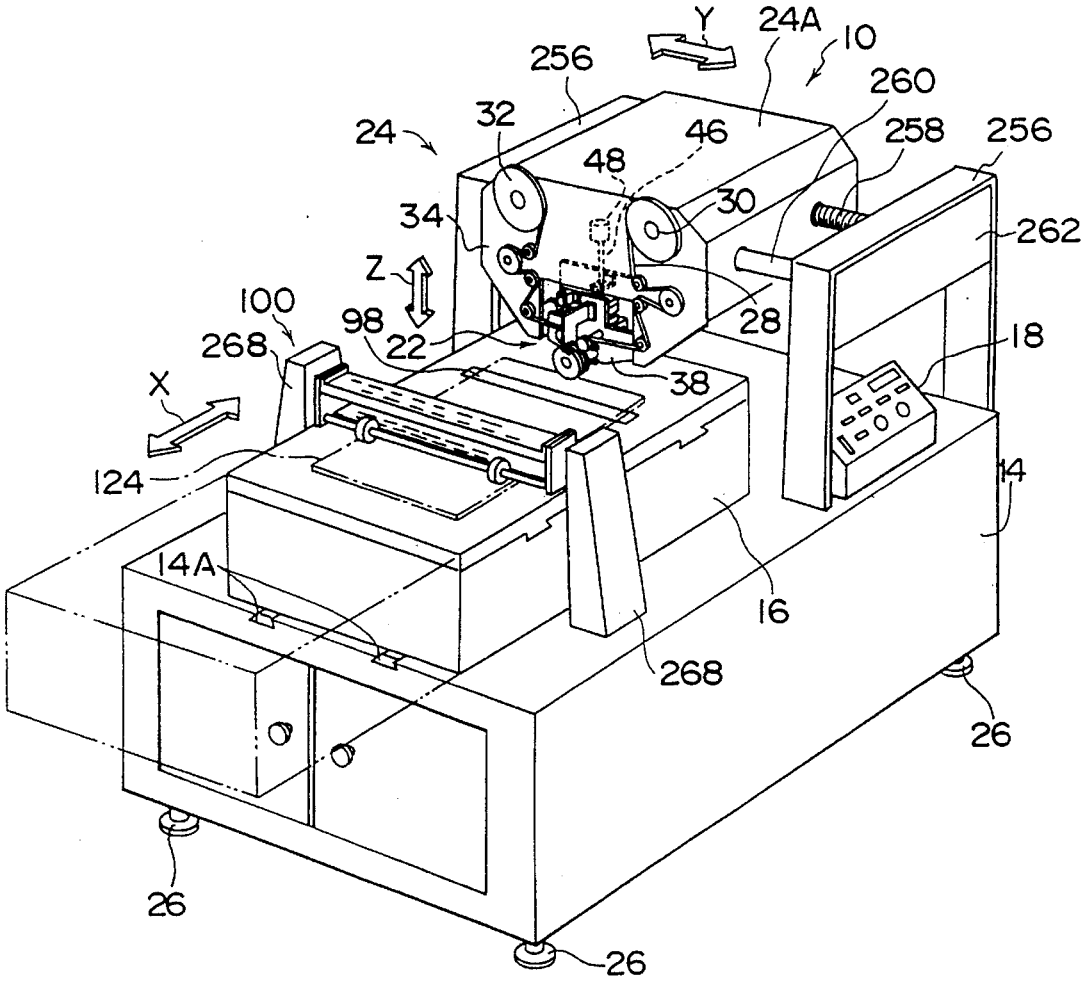
FIG. 9 is a perspective view illustrating an automatic inspection/grinding apparatus in accordance with a second embodiment.

FIG. 9 shows an automatic inspection/grinding apparatus 10 in accordance with a second embodiment.

In the drawings referred to below, the direction of arrow X indicates the longitudinal direction of the apparatus, the direction of arrow Y indicates the transverse direction of the apparatus, and the direction of arrow Z indicates the vertical direction of the apparatus.

In this inspection/grinding apparatus 10, an inspection/grinding table 16 and an operation panel 18 are disposed on an upper surface of a base 14. The base 14 is supported by a plurality of legs 26 on the underside thereof, and the upper surfaces of the base 14 and the inspection/grinding table 16 are adjustable so as to be horizontal.

Figure 16:
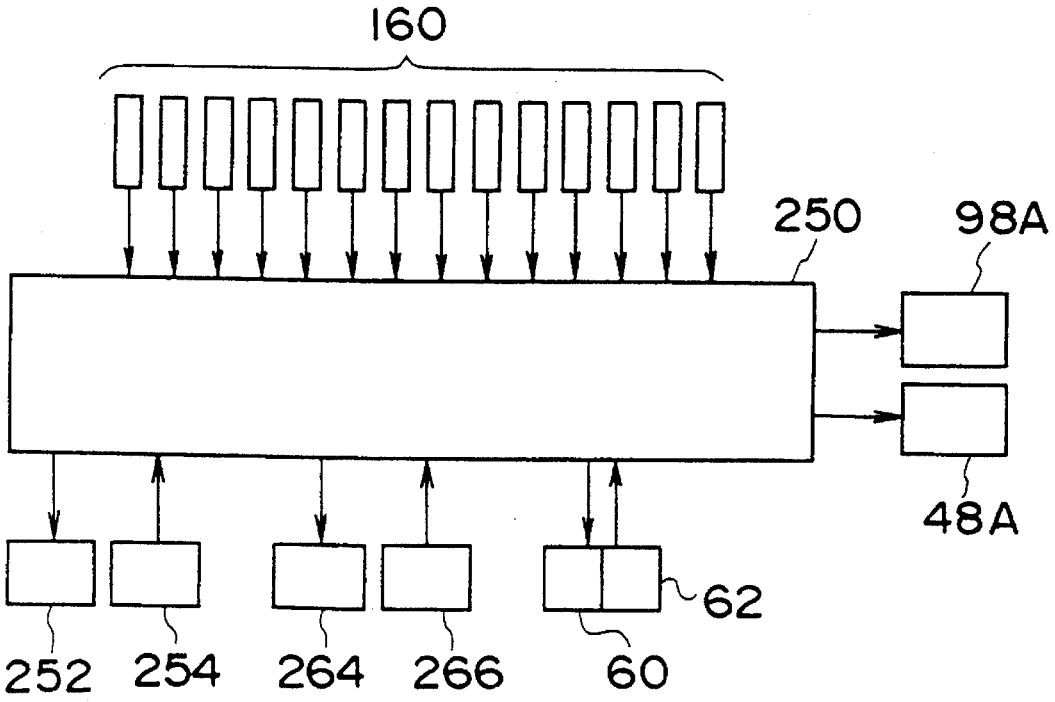
FIG. 16 is a control block diagram in accordance with the second embodiment.

A pair of mutually parallel rail grooves 14A are formed on the base 14, and the inspection/grinding table 16 is fitted in the rail grooves 14A. As shown in FIG. 16, the inspection/grinding table 16 is moved along the rail grooves 14A by the driving force of a motor 252 connected to a controller 250 (in the direction of arrow X in FIG. 9). Incidentally, this motor 252 corresponds to the motor 118 for driving the moving table 106 described in the above described first embodiment, and is provided with a pulse encoder 254 (corresponding to the pulse encoder 128 in the first embodiment).

A pair of substantially U-shaped supporting stands 256 are respectively disposed on both sides of one longitudinal end of the apparatus where the operation panel 18 is disposed, and two shafts 258 and 260 extend between the supporting stands 256. The grinding unit 24 having a grinding head 22, which is located at a predetermined position above the inspection/grinding table 16 in face-to-face relation thereto, is mounted on intermediate portions of these two shafts 258 and 260. The grinding unit 24 is covered with a casing 24A, and the two shafts 258 and 260 are passed through the casing 24A. An external thread is formed on one shaft 258, and is threadedly engaged with an internal thread formed in the casing 24A of the grinding unit 24 (hereafter, the shaft 258 with the external thread will be referred to as a drive shaft 258, and the other shaft 260 will be referred to as a guide shaft 260).

A drive unit 262 is disposed in an upper portion of one supporting stand 256, and a motor 264 (see FIG. 16) is incorporated therein. The rotating shaft of the motor 264 is coupled to the drive shaft 258. As the drive shaft 258 is rotated by the driving force of the motor 264, the grinding unit 24 is guided by the guide shaft 260, and is moved in the axial direction of the guide shaft 260.

As shown in FIG. 16, the motor 264 is connected to the controller 250, and is rotated in the forward and reverse directions in response to signals from the controller 250.

In addition, the motor 264 is provided with a pulse encoder 266, so that the controller 250 is capable of detecting the amount of movement (position) of the grinding unit 24 driven by the motor 264 on the basis of a pulse value from the pulse encoder 266.

As shown in FIG. 9, a pair of columns are disposed uprightly on this side of the base 14 in such a manner as to sandwich the inspection/grinding table 16. These columns 268 correspond to the vertical walls 104 described in the first embodiment. The surface inspection unit 100 extends between the columns 268. The support rollers 138 of the surface inspection unit 100 are supported by the inspection/grinding table 16. Namely, this inspection/grinding table 16 corresponds to the moving table 106 (placing table 126) described in the first embodiment.

Signal lines of the photosensors 160 attached to the surface inspection unit 100 are connected to the controller 250 so as to supply the positional information on the projection 124A to the controller 250. Namely, when the color filter 124 is placed at a predetermined position (see the alternate long and short dash line in FIG. 9) on the inspection/grinding table 16, and the inspection/grinding table 16 is moved from the position of the alternate long and two short dashes line in FIG. 9 toward the position of the solid line, it is possible to inspect the presence or absence of the projection 124A attached on the color filter 124. In addition, as the inspection/grinding table 16 is further moved (moved further toward the innermost side from the position of the solid line), it is possible to move the color filter 124 to the position where the grinding unit 24 is disposed.

In the controller 250, the positional information on the projection 1.24A detected by the surface inspection unit 100 is transmitted to the grinding unit 24, so as to move a grinding roller 78, which will be described later, to the position where the projection 124A is attached, by the movement (in the X direction) of the inspection/grinding table 16 and the movement (in the Y direction) of the grinding unit 24.

Hereafter, a detailed description will be given of the arrangement of the grinding unit 24.

A tape roll 30 in which a grinding tape 28, i.e., a grinding member, is taken up in roll form is disposed on the grinding unit 24. An intermediate portion of the grinding tape 28 drawn out from the tape roll 30 is wound around the grinding roller 78 of the grinding head 22, which will be described later, and a leading end portion thereof is wound around a takeup roll 32. An unillustrated winding means is provided between the takeup roll 32 and the tape roll 30, and is arranged such that the grinding tape 28, while being drawn out from the tape roll 30 by fixed amounts, is taken up onto the takeup roll 32. The grinding tape 28 has a thickness of approximately 30 μm (±6 μm or thereabouts), and although its thickness varies depending on each roll, the thickness of the tape in one roll is finished uniformly to a fixed dimension, and fine grinding particles are prepared and deposited thereon.

In the grinding section of the automatic inspection/grinding apparatus 10 used in this embodiment, projections and foreign objects projecting from the surface of the color filter 124 by approximately 3 to 4 μm or more are removed by this grinding tape 28. The projections and foreign objects projecting from the surface of the color filter 124 by approximately 3 to 4 μm or more are first inspected by the surface inspection unit 100, and the inspection/grinding table 16 is moved to the predetermined position on the basis of the positional information ascertained by the controller 250, so as to effect a grinding operation.

Figure 12:
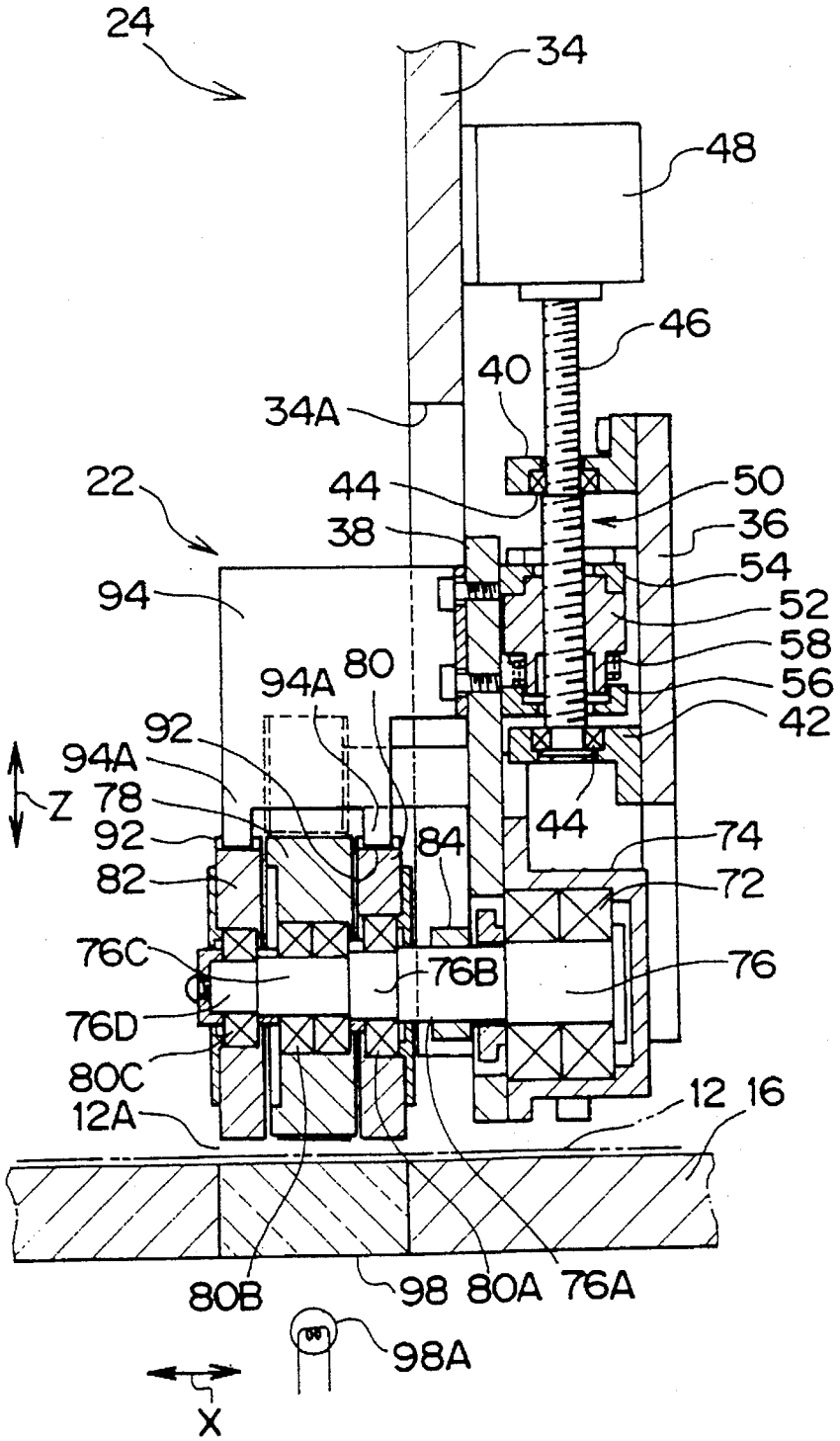
FIG. 12 is a cross-sectional view, taken along 12—12 in FIG. 11, of an essential portion of the grinding head.
Figure 13:
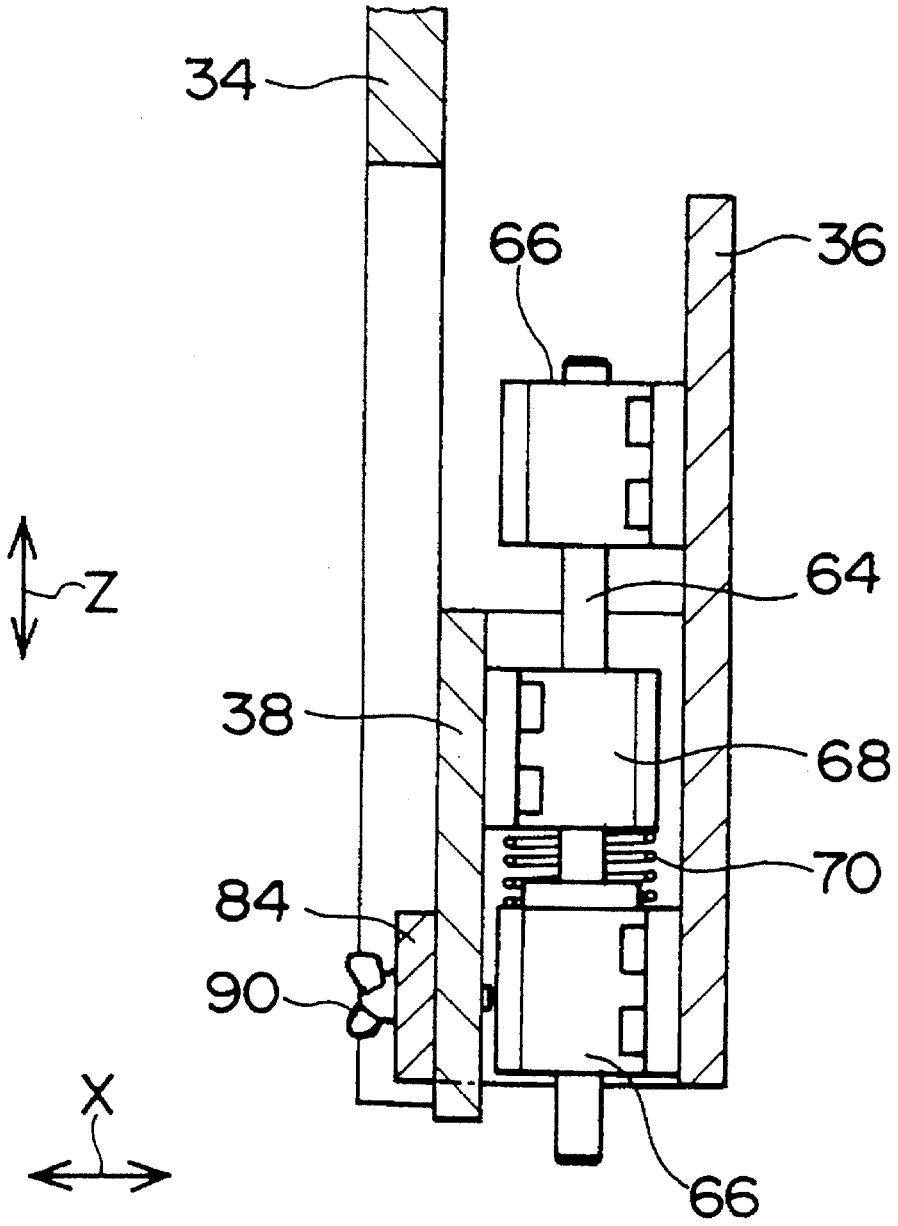
FIG. 13 is a cross-sectional view, taken along line 13—13 in FIG. 11, of an essential portion of the grinding head.

As also shown in FIG. 12, in the inspection/grinding table. 16 for placing the color filter 124 thereon, a light-transmitting member 98 is embedded in a moving zone of the grinding head 22, so as to transmit light radiated from a light source 98A (shown in FIG. 12) disposed inside the inspection/grinding table 16 as an illuminating means. This arrangement is provided to ensure that the projection 124A can be clearly discerned visually as well by locating the projection 124A of the color filter 124 on the light-transmitting member 98 when the color filter 124 is ground.

The main moving direction of the inspection/grinding table 16 is the direction of arrow X; however, an upper section of the inspection/grinding table 16 is also movable with respect to a lower section thereof in the direction of arrow Y in FIG. 9. When a predetermined portion (projection 124A) of the color filter 124 is ground by the grinding tape 28, the upper section of the inspection/grinding table 16 is moved by a predetermined amount in an opposite direction (rightwardly in the direction of arrow Y in this embodiment) to the traveling direction of the grinding tape 28, so as to grind a predetermined range (a range defined by the widthwise dimension of the grinding tape 28 and the amount of movement of the inspection/grinding table 16) of the color filter 124 by the grinding tape 28.

Referring now to FIGS. 9 to 15, a detailed description will be given of the grinding head 22 disposed in the grinding unit 24.

As shown in FIG. 9, the tape roll 30, the takeup roll 32, and a plurality of rollers around which an intermediate portion of the grinding tape 28 between the tape roll 30 and the takeup roll 32 are wound, are disposed on a baseplate 34 constituting a front panel of the grinding unit 24. These rollers have their outside diameters varied by small degrees, respectively, or some of the rollers are urged in the direction of imparting tension to the grinding tape 28, so that a fixed tension will be imparted to the grinding tape 28 when the grinding tape 28 is taken up onto the takeup roll 32.

An unillustrated cover for covering the grinding tape 28 is provided in such a manner as to extend between the tape roll 30 and the takeup roll 32. This cover prevents dust and the like in the air from being attached to the grinding tape 28, and prevents foreign substances and the like, which are attached to the surface of the grinding tape 28 after being removed from the surface of the color filter 124, from being scattered to the rear side.

As shown in FIGS. 10 to 13, a notch 34A is formed in a lower portion of a central portion of the baseplate 34 of the grinding unit 24. A baseplate 36 is disposed on the innermost side of the notch 34A (on an arm 20 side) via a pair of spacers 35 in such a manner as to be parallel with the baseplate 34. Further, a head base 38 constituting a part of the grinding head 22 is disposed in the notch 34 in face-to-face relation to the baseplate 36 in such a manner as to be vertically movable in parallel with the baseplate 36.

Figure 10:
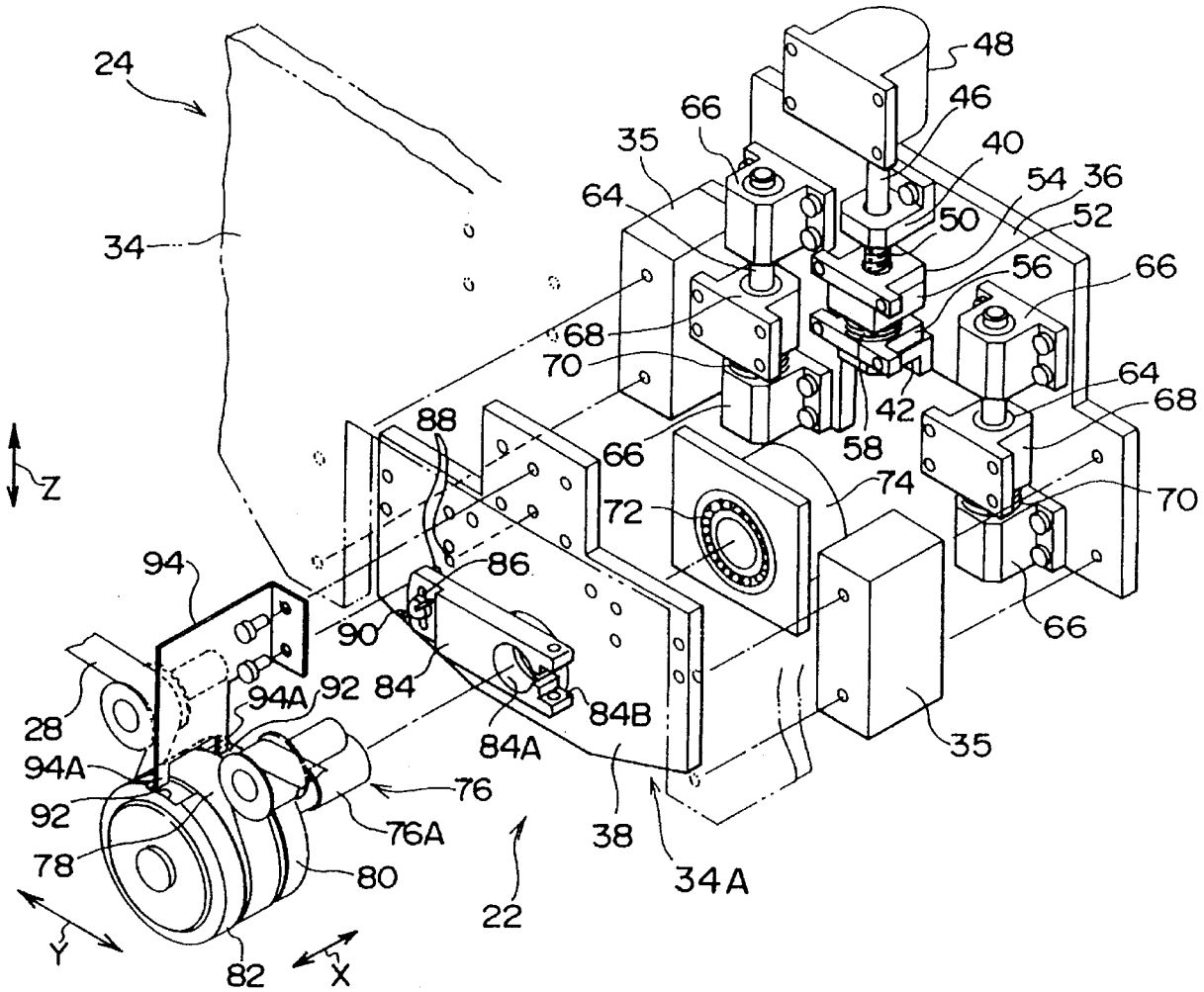
FIG. 10 is an exploded perspective view schematically illustrating an arrangement of a grinding head in accordance with the second embodiment.
Figure 11:
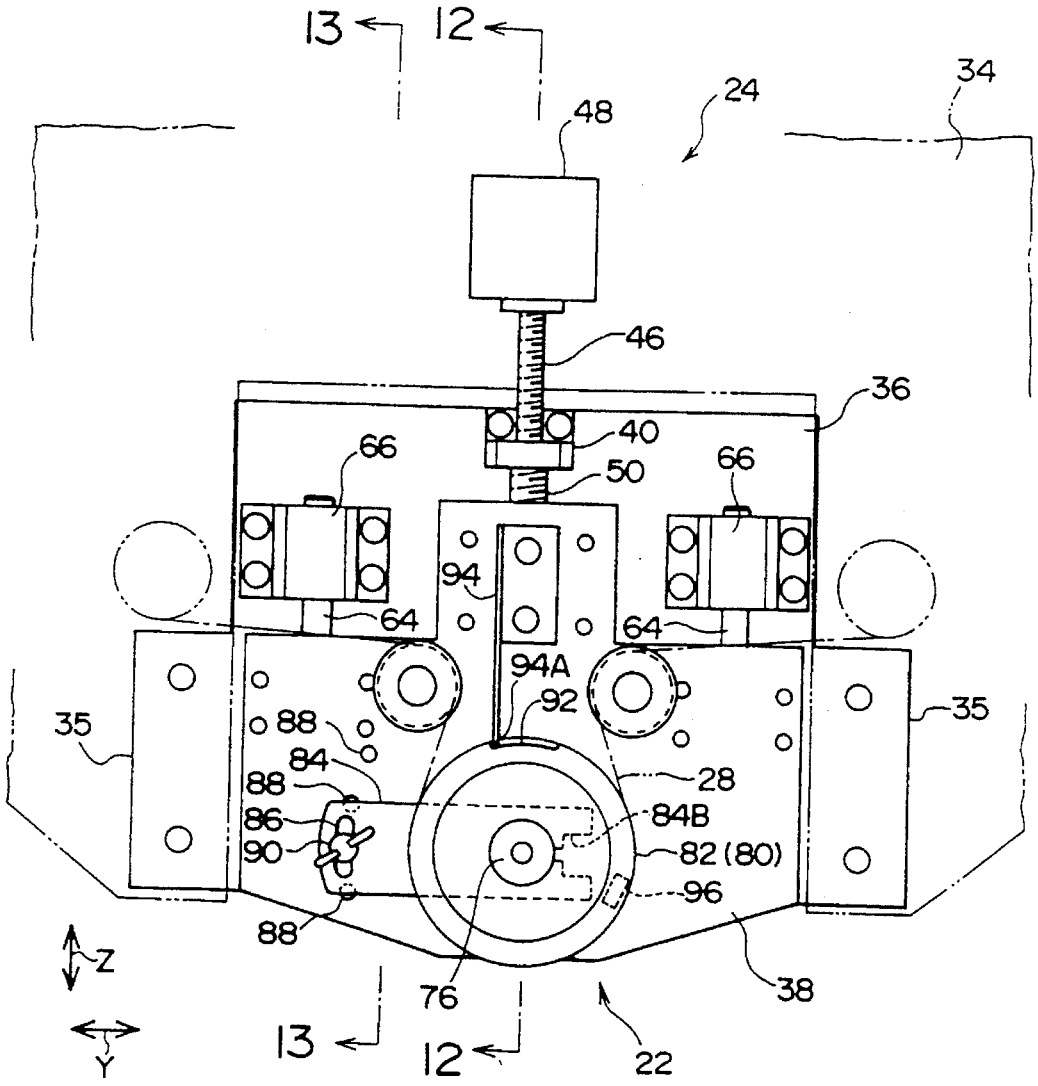
FIG. 11 is a schematic side elevational view of the grinding head in accordance with the second embodiment.

As shown in FIGS. 10 to 12, a pair of upper and lower brackets 40 and 42 are disposed in a central portion of the baseplate 36. Bearings 44 are disposed in the pair of brackets 40 and 42, and a shaft 46 is inserted through these brackets 40 and 42. The upper bracket 40 rotatably supports an intermediate portion of the shaft 46, while the lower bracket 42 rotatably supports a lower end of the shaft 46, and holds the shaft 46 by preventing the downward movement thereof.

A distal-end portion of the shaft 46 projecting upwardly from the bracket 40 is coupled to an unillustrated drive shaft of a motor box 48 mounted on the baseplate 34. The motor box 48 is adapted to reduce the rotation of an internal motor 48A (see FIG. 16) and transmit the rotational force to the shaft 46, so as to rotatively drive the shaft 46.

A feed screw portion 50, which constitutes a moving means and on which an external thread is cut, is formed on an outer peripheral portion of the shaft 46 between the brackets 40 and 42. A feed nut 52, which serves as a second moving member, is threadedly engaged on the feed screw portion 50.

An intermediate portion of the feed screw portion 50 is inserted through a pair of brackets 54 and 56 fixed to the head base 38 and serving as a first moving member, and are arranged such that the feed nut 52 is located between the brackets 54 and 56. The feed nut 52 is made to abut against the upper bracket 54 by the urging force of a compression coil spring 58 disposed between the feed nut 52 and the lower bracket 56. In addition, the feed nut 52 is disposed with this outer peripheral portion located in close proximity to the surface of the head base 38, so as to prevent its rotation about the feed screw portion 50 (not illustrated).

Consequently, as the shaft 46 is rotated by the operation of the motor box 48, the position at which the feed nut 52 is threadedly engaged on the feed screw portion 50 moves. In conjunction with the movement of the feed nut 52, the head base 38 is vertically moved together with the bracket 54 abutting against the feed nut 52. Here, when the domward movement of the head base 38 is stopped during the downward movement of the feed nut 52, the feed nut 52 is moved downward away from the bracket 54 against the urging force of the compression coil spring 58.

Figure 15:
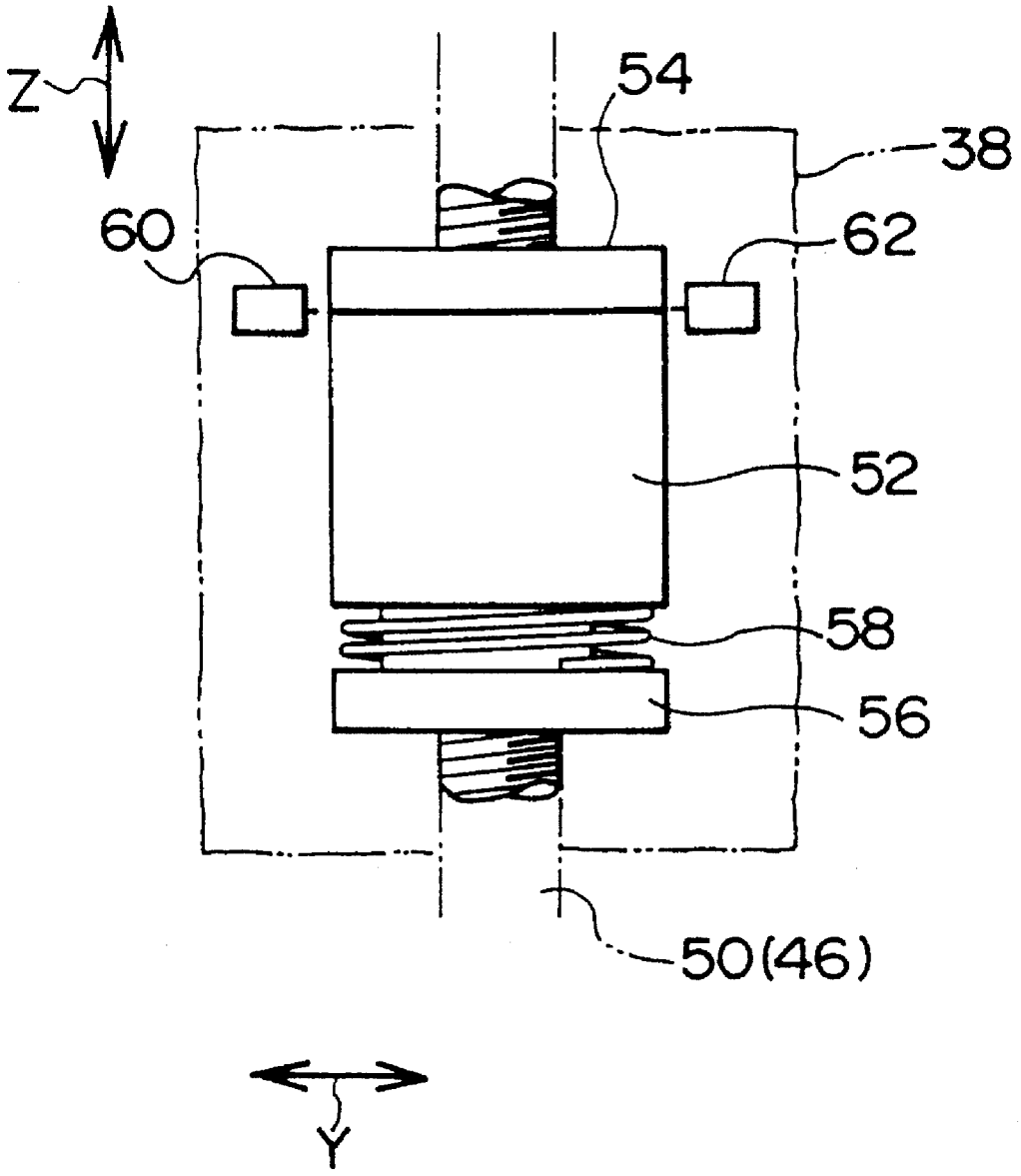
FIG. 15 is a side elevational view, taken from a baseplate side, of a head base in accordance with the second embodiment.

As shown in FIG. 15, a light-projecting unit 60 and a light-receiving unit 62, which serve as a detecting means, are disposed on the head base 38 such as to be located on both sides of the contacting portions of the bracket 54 and the feed nut 52. The light-projecting unit 60 is adapted to radiate a predetermined light beam toward the light-receiving unit 62 by a light-emitting diode or the like, while the light-receiving unit 62 is adapted to detect the light beam from the light-projecting unit 60 by a light-receiving element.

Normally, since the bracket 54 and the feed nut 52 are in contact with each other, the light beam radiated from the light-projecting unit 60 is shielded by the bracket 54 and the feed nut 52. Here, when the feed nut 52 is moved away from the bracket 54 during the operation of the motor box 48, as described above, and a small gap is produced between the bracket 54 and the feed nut 52, the light beam emitted from the light-projecting unit 60 passes through this small gap, reaches the light-receiving unit 62, and is thereby detected. Consequently, in the grinding section of the automatic inspection/grinding apparatus 10, the stopping of the downward movement of the head base 38 is detected. When the stopping of the downward movement of the head base 38 is detected, the driving of the motor 48A in the motor box 48 is stopped instantaneously to stop the downward movement of the feed nut 52.

Meanwhile, as shown in FIGS. 10 and 11, a pair of guide shafts 64 are disposed on both sides of the shaft 46 in parallel therewith. An upper end portion and a lower end portion of each of these guide shafts 64 are respectively supported by brackets 66 fixed to the baseplate 36, and an intermediate portion thereof is slidably inserted through a bracket 68 fixed to the head base 38. A compression coil spring 70 is interposed between the bracket 68 and the lower bracket 66. The arrangement provided is such that the head base 38 is supported onto the baseplate 36 via the compression coil spring 70 between the bracket 68 and the lower bracket 66 on each side of the shaft 46.

In other words, the grinding head 22 is supported by the baseplate 36 via the two compression coil springs 70, and the load of the grinding head 22 is practically not applied between the feed nut 52 and the pair of brackets 54 and 56. In this state, the grinding head 22 is vertically moved together with the feed nut 52 as the feed screw portion 50 is rotatively driven.

As shown in FIGS. 10 to 12, a bearing case 74 accommodating a bearing 72 (shown in FIG. 12) is fixed to a lower end portion of the head base 38. A shaft 76 projecting in a direction away from the baseplate 36 is pivotally supported by the bearing 72. The grinding roller 78 and a pair of guide rollers 80 and 82 with the grinding roller 78 placed therebetween are disposed on the shaft 76. Incidentally, in this embodiment, the diameters of the guide rollers 80 and 82 are set to be substantially identical to the diameter of the grinding roller 78.

The shaft 76 has a shaft body 76A pivotally supported by the bearing 72 as well as reduced-diameter portions 76B, 76C, and 76D whose diameters are consecutively reduced from the shaft body 76A toward the opposite side of the bearing 72. The guide roller 80, the grinding roller 78, and the guide roller 82 are rotatably attached to the reduced-diameter portions 76B, 76C, and 76D via bearings 80A, 78A, 82A, respectively.

Figure 14:
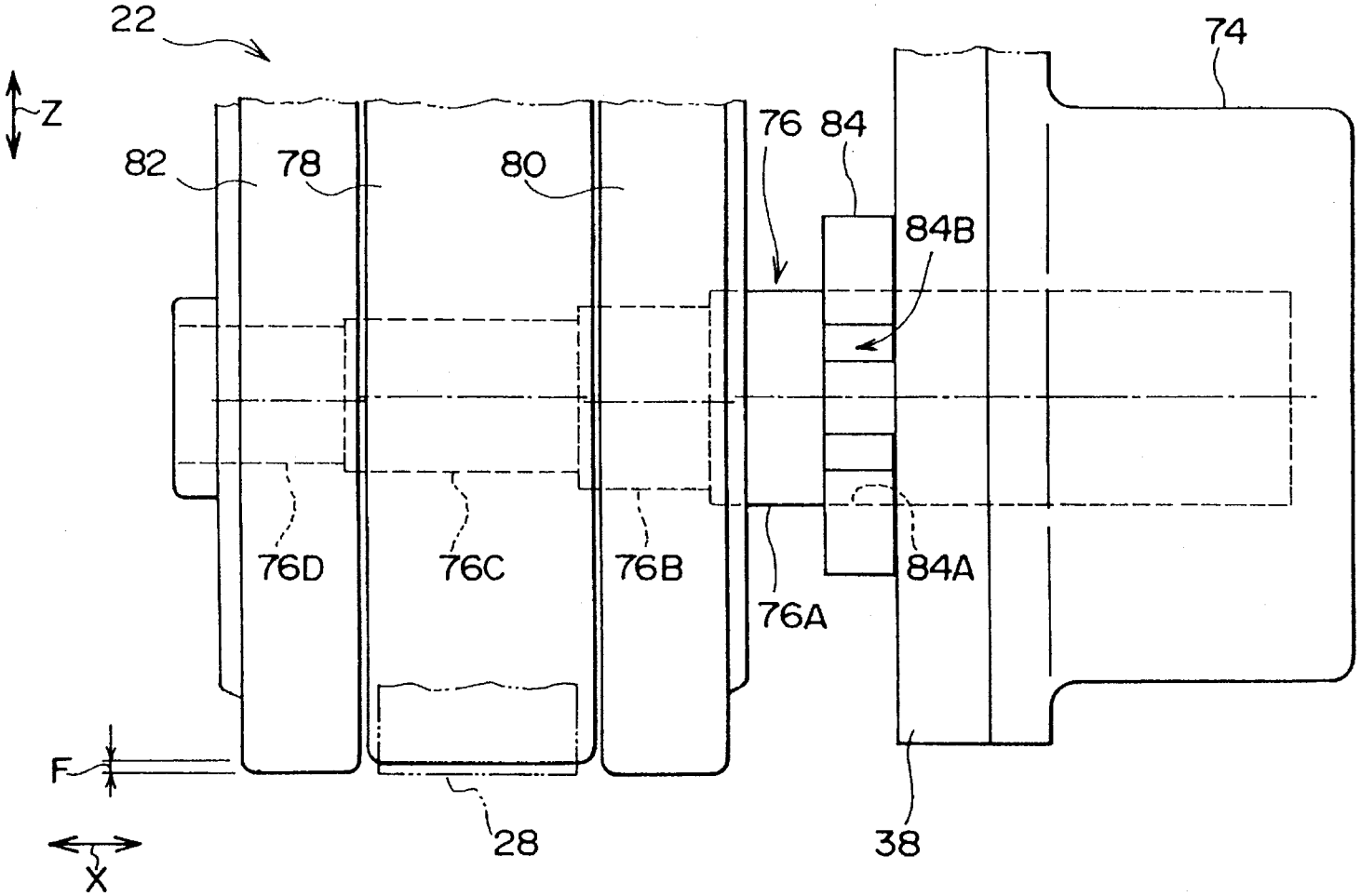
FIG. 14 is an enlarged front view of an essential portion of the grinding head in accordance with the second embodiment.

As shown in FIG. 14, in the shaft 76, the shaft body 76A and the intermediate reduced-diameter portion 76C, on which the grinding roller 78 is disposed, are formed coaxially. However, the axes of the reduced-diameter portions 76B and 76D, on which the pair of guide rollers 80 and 82 are disposed, are formed by being offset from the axes of the shaft body 76A and the reduced-diameter portion 76C. That is, the reduced-diameter portion 76C of the shaft 76 corresponds to a first rotating shaft of the present invention, and the reduced-diameter portions 76B and 76D correspond to second rotating shafts. Thus, the pair of guide rollers 80 and 82 are attached eccentrically with respect to the grinding roller 78 in the same way.

As shown in FIGS. 10 and 11, the shaft 76 is provided with a rotating lever 84 serving as a rotation-holding means. To attach the rotating lever 84 to the shaft 76, a through hole 84A, whose inside diameter is slightly larger than the outside diameter of the shaft body 76A, is bored in one end of the rotating lever 84, and a cutout 84B is formed in the rotating lever 84 in such a manner as to extend from a tip of its longitudinal end portion to the through hole 84A. Then, the shaft body 76A is inserted through the through hole 84A, and the cutout 84B is subjected to caulking or the like to reduce the inside diameter of the through hole 84A, thereby clamping the shaft body 76A and coupling the two members.

Thus, since the outside diameter of the shaft body 76A is made large, and the diameters of the reduced-diameter portions 76B, 76C, and 76D are consecutively reduced, even in the state in which the shaft 76 is fitted in the bearing 72, the rotating lever 84, the guide roller 80, the grinding roller 78, and the guide roller 82 can be consecutively fitted over the shaft 76, and can therefore be fitted easily.

The rotating lever 84 is disposed in such as manner as to rotate along the surface of the head base 38 together with the shaft 76, and the eccentric axial positions of the guide, roller 80 and 82 rotate as the shaft 76 rotates.

An elongated hole 86, which is formed along a circular arc having the axis of the shaft body 76 as its center, is provided at one end portion of the rotating lever 84 away from the shaft body 76A. In addition, a plurality of threaded holes 88 are formed at predetermined intervals in the head base 38 along a circular arc having the axis of the shaft body 76A as its center. As a thumbscrew 90 is inserted into the elongated hole 86 and is threadedly engaged in one of the plurality of threaded holes 88, the rotating lever 84 can be rotated to an arbitrary position within a predetermined range, so as to fix the shaft 76. Consequently, the positions of the axes of the guide rollers 80 and 82, which are eccentric with the axis of the shaft body 76A, can be adjusted and fixed.

As shown in FIG. 14, as the shaft 76 is rotated by the rotating lever 84, the axes of the reduced-diameter portions 76B and 76D, on which the guide rollers 80 and 82 are disposed, are rotated integrally relative to the axis of the reduced-diameter portion 76C, on which the grinding roller 78 is disposed. As a result, the guide rollers 80 and 82 are capable of moving vertically with respect to the grinding roller 78 simultaneously. Hence, a predetermined amount of difference in level, F, can be formed between lower ends (tips on the lower side in FIG. 14) of the guide rollers 80 and 82 on the one hand, and a lower end of the grinding roller 78 on the other. This predetermined amount of difference in level, F, is set to the sum of the thickness (approx. 30 μm) of the grinding tape 28 and an allowable range (approx. 3 to 4 μm) of the projection on the surface of the color filter 124.

Since the predetermined amount of difference in level, F, is provided between the grinding roller 78 and the guide rollers 80 and 82, the gap between the surface of the grinding tape 28 wound around the grinding roller 78 and the surface of the color filter 124 can be maintained within a fixed allowable range when the grinding head 22 is lowered, and the guide rollers 80 and 82 bring the grinding head 22 into contact with the surface of the color filter 124. It should be noted that, since this predetermined amount of difference in level, F, can be set in advance on the basis of the offset between the center of rotation of the rotating lever 84 and the axes of the guide rollers 80 and 82, a scale which serves as the criteria of the predetermined amount of difference in level, F, with respect to the position of the rotating lever 84 may be marked in the vicinities of the plurality of threaded holes 88 in the baseplate 38.

As shown in FIGS. 10 and 11, groove-like notches 92 are formed in outer peripheral portions of the guide rollers 80 and 82 in predetermined ranges. A pair of pawls 94 projecting downward from a stopper 94, which is fixed to an upper central portion of the head base 38, are respectively accommodated in these notches 92. The rotational range of the guide rollers 80 and 82 is restricted by the pawls 94A. In addition, weights 96 (only one is shown in FIG. 11) are disposed in the guide rollers 80 and 82, respectively. The weights 96 are designed impart to the guide rollers 80 and 82 such appropriate angular moment that does not prevent their rotation when the guide rollers 80 and 82 are brought into contact with the color filter 124.

After the guide rollers 80 and 82 rotate in conjunction with the movement of the inspection/grinding table 16, and when the grinding head 22 is raised and the guide rollers 80 and 82 are moved away from the inspection/grinding table 16, the guide rollers 80 and 82 are adapted to rotate due to the weights 96 and return to a predetermined position restricted by the stopper 94.

Figure 17A:
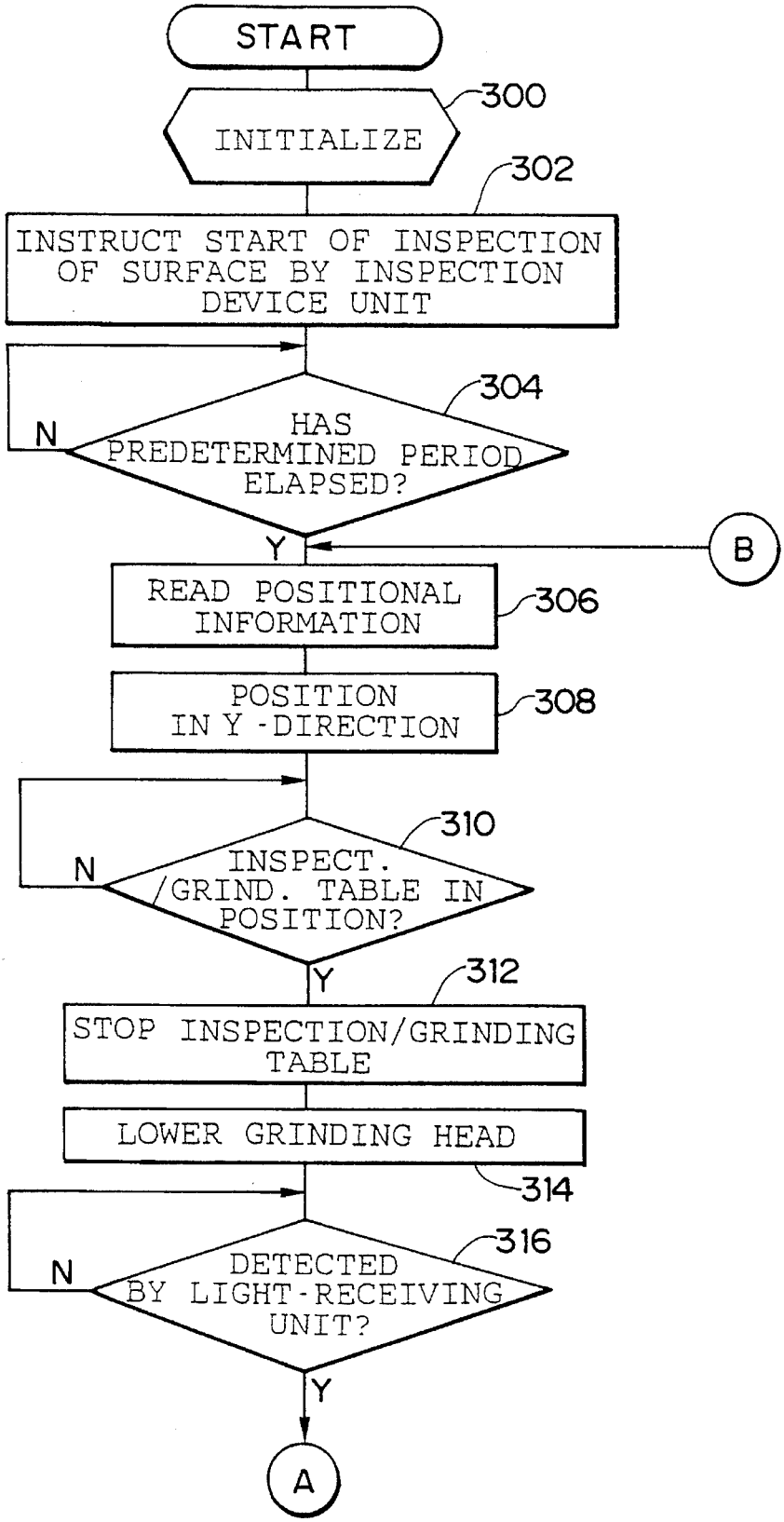
FIGS. 17A and 17B is a control flowchart in accordance with the second embodiment.
Figure 17B:
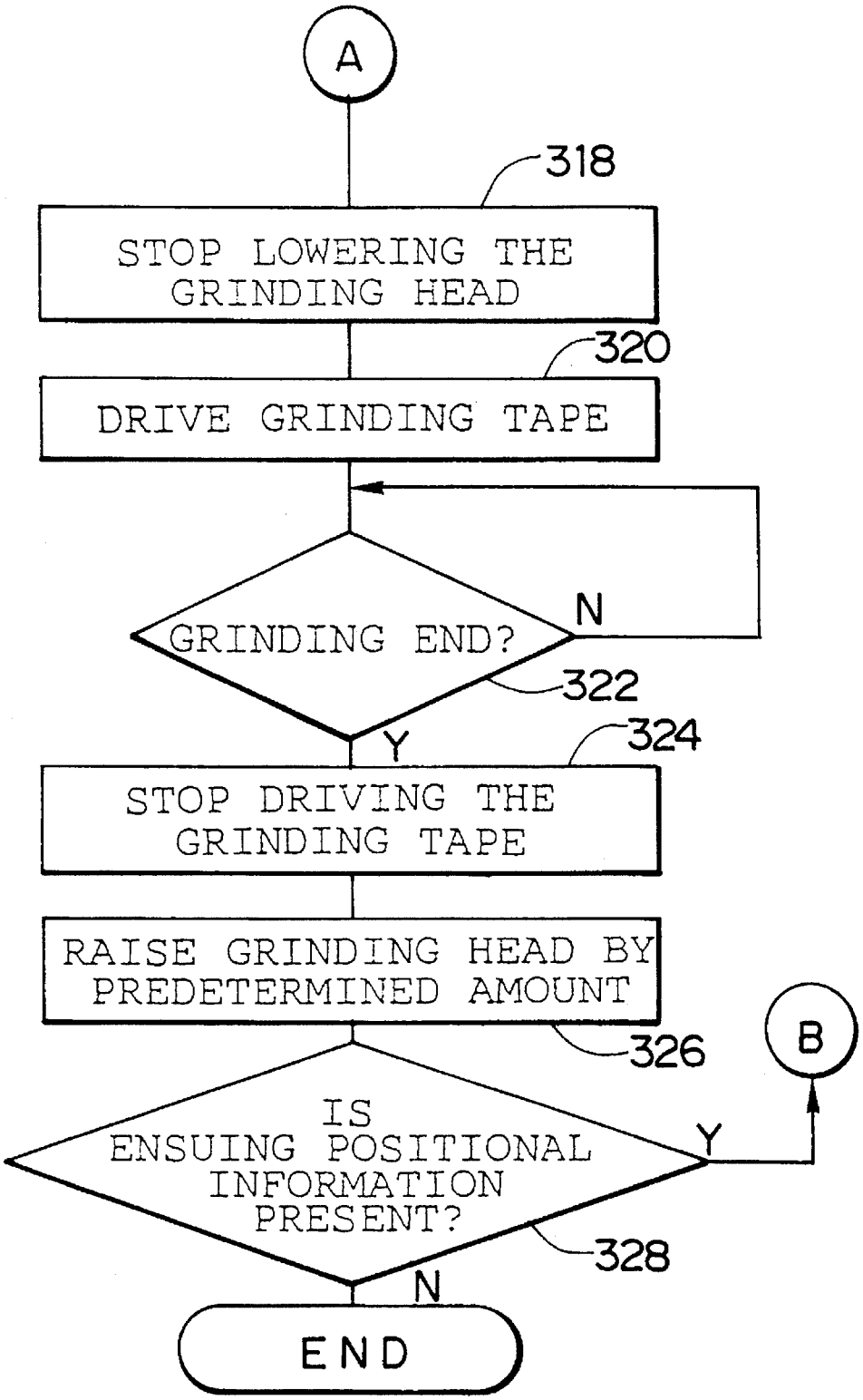

Referring now to the flowchart shown in FIG. 17, a description will be given of the operation of the second embodiment.

In the automatic inspection/grinding apparatus 10, prior to the inspection of the color filter and the grinding operation, the grinding tape 28 is loaded on the grinding unit 24. At this time, by taking into consideration the thickness of the grinding tape 28 and the finish of the color filter 124, the predetermined amount of difference in level, F, between the grinding roller 78 and the guide rollers 80 and 82 is adjusted by the rotating lever 84. The thickness of the grinding tape 28 is substantially fixed in the same roll, but, in the case of a different roll, there are cases where the thickness becomes large (e.g., a largest difference being approximately 12 μm). For this reason, when a new roll of the grinding tape 28 is loaded on the grinding unit 24, it is necessary to adjust the predetermined amount of difference in level, F, between the grinding roller 78 and the guide rollers 80 and 82 in conformity to the thickness of the grinding tape 28. At this time, it is possible to adjust the predetermined amount of difference in level, F, easily and accurately by rotating the rotating shafts (reduced-diameter portions 76B and 76D) of the guide rollers 80 and 82 which are disposed eccentrically with the rotating shaft (reduced-diameter portion 76C) of the grinding roller 78.

After completion of the above adjustment, in Step 300, the initialization of the respective units is carried out, and the operation proceeds to Step 302. In Step 302, an instruction is given to start the inspection of the presence or absence of the projection 124A, and the operation proceeds to Step 304. Incidentally, since the details of this inspection are similar to those of the first embodiment, a description thereof will be omitted (see FIG. 6). When this surface inspection is started, the surface inspection unit 100 continues inspection by independent sequence control.

When a predetermined time duration has elapsed after starting the inspection operation (when the end in the moving direction of the inspection/grinding table 16 has moved to the position of the grinding unit 24), the operation proceeds to Step 306 from Step 304 to read the positional information from the controller 250. In step 308, on the basis of the positional information thus read, the motor 264 is first driven to rotate the drive shaft 258, thereby positioning the grinding head 22 in the Y-direction. Then, in Step 310, a determination is made as to whether the inspection/grinding table 16 has moved by the amount of offset between the grinding position and the position of the projection 124A detected by the feelers 158. If YES is the answer in the determination, the operation proceeds to Step 312 to temporarily stop the inspection/grinding table 16.

In an ensuing Step 314, the motor 48A in the motor box 48 is driven to rotate the shaft 46 and the feed screw portion 50 and move the feed nut 52 downward, thereby lowering the grinding head 22. At this time, the load of the grinding head 22 acts on the brackets 66 of the guide shafts 64 via the compression coil springs 70, and only the urging force of the compression coil spring 58 acts between the feed nut 52 and the brackets 54 and 56, so that the feed nut 52 moves smoothly.

When the grinding head 22 is lowered, and the guide rollers 80 and 82 are brought into contact with the color filter 124 placed on the inspection/grinding table 16, the downward movement of the grinding head 22 is stopped. At this juncture, since the feed screw portion 50 is being rotatively driven, the feed nut 52 is moved downward, and is moved away from the upper bracket 54 against the urging force of the compression coil spring 58. At the same time as the feed nut 52 is moved away from the bracket 54, the light beam radiated from the light-projecting unit 60 disposed in the vicinity of the bracket 54 passes through the small gap between the feed nut 52 and the bracket 54, and reaches the light-receiving unit 62.

When the light-receiving unit 62 thus detects the light beam from the light-projecting unit 60 (Step 316), the driving of the motor box 48 is instantaneously stopped so as to stop the downward movement of the feed nut 52 (Step 318). At this time, although the guide rollers 80 and 82 press the color filter 124 by the urging force of the compression coil spring 58 acting between the feed nut 52 and the bracket 56, this force is very small (e.g., 100 g or less in this embodiment), so that the color filter 124 is not damaged. In addition, when the guide rollers 80 and 82 are brought into contact with the surface of the color filter 124, a fixed gap (approx. 3 to 4 μm in this embodiment) is maintained between the surface of the grinding tape 28 wound around the grinding roller 78 and the surface of the color filter 124 due to the predetermined amount of difference in level, F, which is formed with respect to the grinding roller 78.

It should be noted that the arrangement of the detecting means is not limited to the light-projecting unit 60 and the light-receiving unit 62, and it is possible to adopt various arrangements, such as the one in which a pair of electrodes are disposed between the bracket 54 and the feed nut 52. Also, it is possible to adopt an arrangement in which a very small through hole is provided in the feed nut 52, and the arrival of the grinding head 22 at a predetermined position above the inspection/grinding table 16 is detected when, after the light radiated from the light-projecting unit 60 and passing through the through hole was received by the light-receiving unit 62, the feed nut 52 undergoes relative movement with respect to the grinding head 22, and the position of the through hole becomes offset, shielding the light to the light-receiving unit 62. Thus, various arrangements can be adopted.

In the grinding section of the automatic inspection/grinding apparatus 1D, when the downward movement of the grinding head 22 is stopped (Step 318), in the state in which a predetermined tension is applied to the grinding tape 28, the grinding tape 28 is taken up onto the takeup roller 32 by a predetermined amount (approx. 10 to 15 mm in this embodiment) while being drawn out from the tape roll 30, and the grinding tape 28 is made to travel on the surface of the color filter 124 (Step 320). At the same time, in the grinding section, the upper part of the inspection/grinding table 16 is moved in a direction opposite to the traveling direction of the grinding tape 28. Consequently, the grinding tape 28 is allowed to travel over a predetermined area of the surface of the color filter 124, and grinds large projections and the like on the surface of the color filter 124 down to a predetermined size. At this time, the guide rollers 80 and 82 kept in contact with the color filter 124 rotate in conjunction with the movement of the inspection/grinding table 16, so that the surface of the color filter 124 is not damaged.

Upon completion of the traveling of the grinding tape 28 on the surface of the color filter 124 and the movement of the inspection/grinding table 16 (YES in the determination in Step 322), the traveling of the grinding tape 28 is stopped in Step 324. Then, in Step 326, the motor box 48 is driven so that the grinding head 22 is raised up to a predetermined height and is then stopped. In conjunction with the raising of the grinding head 22, the guide rollers 80 and 82, after moving away from the surface of the color filter 124, rotate due to the weights 96, and return to a predetermined position restricted by the stopper 94. Consequently, the same positions of the guide rollers 80 and 82 are brought into contact with the surface of the color filter 124 when starting the grinding thereof. Hence, it is possible to prevent the predetermined amount of difference in level, F, with respect to the grinding roller 78 from changing due to the rotation of the guide rollers 80 and 82, and it is possible to repeatedly and accurately conduct the grinding operation with the same accuracy on the basis of the information on subsequently specified positions. Namely, in an ensuing Step 326, a determination is made as to whether the positional information is present in the memory, and if YES is the answer in the determination, the operation returns to Step 306 to repeat the above steps.

Meanwhile, if NO is the answer in the determination in Step 326, it is determined that the grinding operation of all the projections 124A detected during inspection has been completed, so that the processing ends.

Thus, in the second embodiment, since the entire operation from the inspection (detection) of the projections 124A to grinding is automated, it is possible to effect the grinding operation accurately and reliably without requiring the otherwise-needed manual operation by the operator.

In addition, the grinding unit 24 used in this embodiment can be adjusted easily even if the thickness of the grinding tape 28 varies, and the amount of grinding can also be adjusted easily. Since, as for the grinding roller 78, the guide rollers 80 and 82, and the shaft 76, which substantially affect the grinding accuracy of the automatic inspection/grinding apparatus 10, those which are processed with high accuracy are easily available, respectively, and since these members are connected by the bearings 80A, 80B, and 80C and the bearing 72, respectively, it is possible to easily obtain very high rotational accuracy. Thus, it is possible to provide a highly accurate automatic inspection/grinding apparatus 10.

In addition, when the color filter 124 is ground, the load acting on the color filter 124 is made small, the surface of the color filter 124 is prevented from becoming damaged.

Although, in this embodiment, the guide rollers 80 and 82, which are disposed as a pair in such a manner as to sandwich the grinding roller 78, are made eccentric with respect to the grinding roller 78 by the shaft 76, at least one of the guide rollers 80 and 82 may be provided, and the guide rollers 80 and 82 may be provided with eccentric rotating shafts which are rotatably disposed separately.

Furthermore, the present invention is applicable to not only the grinding apparatus for grinding the surfaces of the color filters 124 but also grinding apparatuses for grinding surfaces by using, as members to be ground, such as substrates of electronic circuits and high-frequency circuits which require high processing accuracy of flat surfaces.

What is claimed is:

1. An apparatus for detecting a surface of a member to be ground, for determining the presence or absence and position of a projection needed to be ground in a subsequent process, by detecting the surface of the member to be ground, said apparatus comprising:

a moving table which moves on a base;

an inspection base disposed above said moving table and extending in a direction horizontally perpendicular to a moving direction of said moving table;

a plurality of feelers arranged in a longitudinal direction of said inspection base, each of said plurality of feelers being rotatably supported about a lower end face of a shoulder portion straddling over a through hole provided in said inspection base, a distal end of a tongue portion extending from the shoulder portion and passing through the through hole being disposed with a predetermined gap with respect to the surface of the member to be ground, and each of said plurality of feelers being normally maintained in a balanced state;

a plurality of sensors provided respectively for said plurality of feelers, a contact of each of said plurality of sensors being changed over when a state of said feeler changes between a normal state in which said feeler is balanced and an inclined state in which said feeler is rotated about the lower end face of the shoulder portion when the member to be ground is moved in conjunction with the movement of said moving table, and the projection comes into contact with said feeler; and a determining device for determining the presence or absence of the projection on the basis of an output signal from said sensor and for determining the position of the projection on the basis of an amount of movement of said moving table.

2. An apparatus for detecting a surface of a member to be ground according to claim 1, wherein a support roller which is adapted to be supported on said moving base is attached to said inspection base, and a predetermined gap is provided between a lower end of each of said feelers and the surface of the member to be ground as an interval between a horizontal line passing through a lowermost position of said support roller and a horizontal line passing through a lowermost position of each of said feelers is set to a fixed dimension.

3. An apparatus for detecting a surface of a member to be ground according to claim 2, wherein said inspection base is supported on said base via an urging member, and a load corresponding to the urging force of said urging member alleviates a load transmitted from said support roller to said moving table.

4. An apparatus for detecting a surface of a member to be ground according to claim 1, wherein said plurality of feelers are arranged in two or more rows along the longitudinal direction of said inspection base, and form areas for detecting identical locations by said rows during detection of the projection in conjunction with the movement of said moving table.

5. An apparatus for detecting a surface of a member to be ground according to claim 4, wherein when the projection has passed through the area for detecting the identical location, and the projection is detected by two of said feelers, a position of grinding in a subsequent process is determined to be at an intermediate position between said feelers.

6. An apparatus for detecting a surface of a member to be ground according to claim 1, wherein the predetermined gap is 4 μm or less.

7. Feelers used in an apparatus for detecting a surface of a member to be ground according to claim 4, prepared by a process comprising the steps of:

when lower ends of said tongue portions are removed by cutting, fixing said feelers in state in which said feelers are superposed one on top of another by setting as a unit a plurality of feelers used for at least one surface detecting apparatus; and simultaneously cutting lower ends of said feelers such that dimensions between the lower end faces of the shoulder portions and lower end faces of the tongue portions become uniform among said superposed feelers.

8. An automatic inspection/grinding apparatus for determining the presence or absence and position of a projection by inspecting a surface of a member to be ground and for grinding the detected projection, said apparatus comprising:

a moving table which moves on a base;

an inspection base disposed above said moving table and extending in a direction horizontally perpendicular to a main moving direction of said moving table;

a plurality of feelers arranged in a longitudinal direction of said inspection base, each of said plurality of feelers being rotatably supported about a lower end face of a shoulder portion straddling over a through hole provided in said inspection base, a distal end of a tongue portion extending from the shoulder portion and passing through the through hole being disposed with a predetermined gap with respect to the surface of the member to be ground, and each of said plurality of feelers being normally maintained in a balanced state;

a plurality of sensors provided respectively for said plurality of feelers, a contact of each of said plurality of sensors being changed over when a state of said feeler changes between a normal state in which said feeler is balanced and an inclined state in which said feeler is rotated about the lower end face of the shoulder portion when the member to be ground is moved in conjunction with the movement of said moving table, and the projection comes into contact with said feeler;

a determining device for determining the presence or absence of the projection on the basis of an output signal from said sensor and for determining the position of the projection on the basis of an amount of movement of said moving table;

a grinding roller for grinding the projection;

a grinding unit including a supporting member for supporting said grinding roller with a predetermined gap with respect to the surface of the member to be ground, and a lifting device for moving said grinding roller in directions toward and away from the member to be ground during the grinding of the projection, said grinding unit being disposed by being offset in the main moving direction of said moving table with respect to said inspection base, and said grinding unit being supported movably in the direction horizontally perpendicular to the main moving direction of said moving table;

a moving device for moving said grinding unit in the direction horizontally perpendicular to the main moving direction of said moving table;

a positioning device for determining a position of said grinding unit in the direction horizontally perpendicular to the main moving direction of said moving table by controlling said moving device on the basis of positional information obtained by said determining means; and a controller for executing grinding by causing said grinding unit to be brought into contact with the member to be ground, by controlling said lifting device on the basis of the amount of movement of said moving table at a time of detection of the projection by said feeler and an amount of offset between the position detected by said feeler and a grinding position of said grinding unit.

9. An automatic inspection/grinding apparatus according to claim 8, wherein a predetermined range of a surface of said grinding roller is used to grind the projection.

10. An automatic inspection/grinding apparatus according to claim 8, wherein said moving table moves in a direction opposite to a rotating direction of said grinding roller at its grinding position so as to reliably grind the projection when the projection is ground.

11. An automatic inspection/grinding apparatus according to claim 8, wherein said predetermined gap can be set in a multiplicity of stages.

12. An automatic inspection/grinding apparatus according to claim 8, wherein said supporting member is constituted by at least one roller member, and said grinding roller and said roller member are juxtaposed to each other with their rotating shafts arranged slightly eccentrically with each other, so as to cause said grinding roller to float by means of said roller member, whereby the predetermined gap is secured.

13. An automatic inspection/grinding apparatus according to claim 8, wherein said lifting device has a detector for detecting that said grinding roller has approached the member to be ground.

14. An apparatus for detecting a surface of a member to be ground, for determining the presence or absence and position of a projection needed to be ground in a subsequent process, by detecting the surface of the member to be ground, said apparatus comprising:

a moving table which moves on a base;

an inspection base disposed above said moving table and extending in a direction horizontally perpendicular to a moving direction of said moving table;

a plurality of feelers arranged in a longitudinal direction of said inspection base, each of said plurality of feelers being rotatably supported about a lower end face of a shoulder portion straddling over a through hole provided in said inspection base, a distal end of a tongue portion extending from the shoulder portion and passing through the through hole being disposed in contact with the surface of the member to be ground;

a plurality of sensors provided respectively for said plurality of feelers, a contact of each of said plurality of sensors being changed over when a state of said feeler changes between a normal state in which said feeler is balanced and an inclined state in which said feeler is displaced by said feeler when the member to be ground is moved in conjunction with the movement of said moving table; and a determining device for determining the presence or absence of the projection on the basis of an output signal from said sensor and for determining the position of the projection on the basis of an amount of movement of said moving table.

15. An apparatus for detecting a surface of a member to be ground according to claim 14, wherein a support roller which is adapted to be supported on said moving base is attached to said inspection base, and said feelers are maintained in a state of contact under a very small contact pressure with respect to the member to be ground as a horizontal line passing through a lowermost position of said support roller and a horizontal line passing through a lowermost position of each of said feelers is aligned with each other.

16. An apparatus for detecting a surface of a member to be ground according to claim 14, wherein a distal end of each of said feelers is rounded so as to come into contact with the surface of the member to be ground at a curved surface thereof.

* * * * *